US011933580B2

(12) United States Patent
Vabnick et al.

(10) Patent No.: US 11,933,580 B2
(45) **Date of Patent: *Mar. 19, 2024**

(54) SHAPED CHARGES FOR FOCUSING A FLUID MASS

(71) Applicant: Federal Bureau of Investigation, Washington, DC (US)

(72) Inventors: Ian B. Vabnick, Fredericksburg, VA (US); Lee R. Foltz, Indian Head, MD (US); Daniel E. McCarthy, La Plata, MD (US); Marc J. La Belle, Buffalo, NY (US); Michael S. Shattuck, Port Royal, VA (US)

(73) Assignee: The United States of America as Represented by the Federal Bureau of Investigation, Department of Justice, Washington, DC (US)

( * ) Notice: Subject to any disclaimer, the term of this patent is extended or adjusted under 35 U.S.C. 154(b) by 575 days.

This patent is subject to a terminal disclaimer.

(21) Appl. No.: 17/170,304

(22) Filed: Feb. 8, 2021

(65) Prior Publication Data

US 2021/0404777 A1 Dec. 30, 2021

Related U.S. Application Data

(63) Continuation-in-part of application No. 16/987,942, filed on Aug. 7, 2020, now Pat. No. 11,262,155, and a continuation-in-part of application No. 16/853,362, filed on Apr. 20, 2020, now Pat. No. 10,921,089.

(60) Provisional application No. 62/884,961, filed on Aug. 9, 2019.

(51) Int. Cl.

| | |
|---|---|
| ***F41B 9/00*** | (2006.01) |
| ***F42B 1/028*** | (2006.01) |
| ***F42B 1/032*** | (2006.01) |

(52) U.S. Cl.

CPC ..... *F41B 9/0046* (2013.01); *F42B 1/028* (2013.01); *F42B 1/032* (2013.01)

(58) Field of Classification Search

CPC .. F42B 1/00; F42B 1/024; F42B 1/028; F42B 1/02; F42B 12/10; F41B 9/0046

See application file for complete search history.

(56) References Cited

U.S. PATENT DOCUMENTS

| | | | |
|---|---|---|---|
| 2,491,516 | A | 12/1949 | Piggot et al. |
| 3,100,445 | A | 8/1963 | Poulter |
| 4,046,055 | A | 9/1977 | McDonalds et al. |

(Continued)

FOREIGN PATENT DOCUMENTS

| | | | |
|---|---|---|---|
| ES | 2083894 | A2 | 4/1996 |
| GB | 2083894 | A2 | 3/1982 |

*Primary Examiner* — Benjamin P Lee

(74) *Attorney, Agent, or Firm* — Leydig, Voit & Mayer, Ltd.

(57) ABSTRACT

Provided herein are shaped charges for focusing a fluid mass and related methods of using the shaped charges for disruption of an explosive target with a spherical projectile. The shaped charge comprises a plastic shell having a special geometric shape configured to support a shape-conforming explosive. A cylindrical plastic body has an interior volume for containing a fluid and the plastic shell. The plastic body closed distal end has a geometric shape that is substantially matched to the shape of the plastic shell. Metal spherical projectiles having an outer layer of metal selected to have an effective density matched to the fluid provide advantageous target disruption capabilities.

20 Claims, 26 Drawing Sheets

(56) References Cited

U.S. PATENT DOCUMENTS

| | | | |
|---|---|---|---|
| 4,169,403 | A | 10/1979 | Hanson |
| 4,779,511 | A | 10/1988 | Proctor et al. |
| 4,955,939 | A | 9/1990 | Petrousky et al. |
| 4,957,027 | A | 9/1990 | Cherry |
| 5,134,921 | A | 8/1992 | Breed et al. |
| 5,210,368 | A | 5/1993 | Heller, Jr. et al. |
| 5,230,324 | A | 7/1993 | Van Horssen et al. |
| 5,460,154 | A | 10/1995 | Mattern et al. |
| 5,460,155 | A | 10/1995 | Hobbs, II |
| 5,785,038 | A | 7/1998 | Mattern |
| 5,792,977 | A | 8/1998 | Chawla |
| 6,269,725 | B1 | 8/2001 | Cherry |
| 6,439,127 | B1 | 8/2002 | Cherry |
| 6,490,957 | B1 | 12/2002 | Alexander et al. |
| 6,532,947 | B1 | 3/2003 | Rosa et al. |
| 6,584,908 | B2 | 7/2003 | Alford |
| 6,644,166 | B2 | 11/2003 | Alexander et al. |
| 7,401,766 | B2 | 7/2008 | Schorloff et al. |
| 8,091,479 | B1 | 1/2012 | Jakaboski et al. |
| 8,276,495 | B1 | 10/2012 | Chiu et al. |
| 8,677,902 | B1 | 3/2014 | Rock et al. |
| 9,322,624 | B2 | 4/2016 | Alford et al. |
| 9,322,625 | B1 | 4/2016 | Langner |
| 9,360,222 | B1 | 6/2016 | Collier |
| 9,404,718 | B1 | 8/2016 | Shaver et al. |
| 9,453,713 | B1 | 9/2016 | Langner |
| 9,958,245 | B1 | 5/2018 | Shih et al. |
| 9,976,838 | B1 | 5/2018 | Langner |
| 10,054,388 | B1 | 8/2018 | Langner |
| 10,066,916 | B1 | 9/2018 | Vabnick et al. |
| 10,451,378 | B2 | 10/2019 | Vabnick et al. |
| 10,495,433 | B1 | 12/2019 | Langner |
| 10,760,872 | B2 | 9/2020 | Vabnick |
| 10,794,660 | B2 | 10/2020 | Vabnick |
| 10,921,089 | B1 | 2/2021 | Vabnick et al. |
| 2003/0131749 | A1 | 7/2003 | Lussier |
| 2005/0081706 | A1 | 4/2005 | Alford |
| 2006/0163544 | A1 | 7/2006 | Schlorff et al. |
| 2011/0061521 | A1 | 3/2011 | Gardner et al. |
| 2018/0259306 | A1 | 9/2018 | Trefilov |
| 2019/0249944 | A1 | 8/2019 | Vabnick et al. |
| 2019/0309606 | A1 | 10/2019 | Loehken et al. |
| 2020/0025508 | A1 | 1/2020 | Vabnick |
| 2020/0056858 | A1 | 2/2020 | Vabnick |
| 2020/0173761 | A1 | 6/2020 | Vabnick |
| 2021/0041205 | A1 | 2/2021 | Vabnick |

D=Diameter, W=shell wall thickness

Rear View

Rear Iso View

SHAPED CHARGES FOR FOCUSING A FLUID MASS

CROSS-REFERENCE TO RELATED APPLICATIONS

This application is a continuation-in-part of U.S. patent application Ser. No. 16/853,362 filed Apr. 20, 2020 and also is a continuation in part of Ser. No. 16/987,942 filed Aug. 7, 2020 which claims the benefit of and priority to U.S. Provisional Patent Application No. 62/884,961 filed Aug. 9, 2019, each of which are specifically incorporated by reference in its entirety to the extent not inconsistent herewith.

STATEMENT OF GOVERNMENT INTEREST

The inventions described herein were invented by employees of the United States Government and thus, may be manufactured and used by or for the U.S. Government for governmental purposes without the payment of royalties.

BACKGROUND OF INVENTION

Explosively-propelled liquids are used to disrupt explosive devices, including improvised explosive devices (IEDs). One system relies on mass-focusing shaped charges to propel a liquid fluid on target.

There are several commercial and improvised shaped charges that drive water and each have their strengths and weaknesses. A common method is to attach the explosives to a plastic former which is either seated inside the fluid, sandwiched between fluid chambers, or is on the outside surface of the fluid container. Pressure fields are produced by shaping explosives into hemispherical, linear (wedge or hemi-cylindrical), rod and conical charge geometries. When the explosives are initiated, shocks form inside the water column and reflect off of the free field surfaces. Various parameters such as angles and corners within the container of fluid or on the explosive former define the pressure-time history of the gases and shocks acting on the water. There are regions of high and low pressure that will differentially accelerate the water to form a jet. High pressure regions are due to a Mach-stem effect which are formed by collisions of shocks, usually along a central axis or plane. A slug of water is the projectile, and water behind the explosives traps the gases, thus increasing the duration of pressure acting on the slug. Shocks can also reflect off the free field boundary of the tamper's rear surface and move back into the water, amplifying the pressure.

A common charge configuration of mass focusing shaped charges driving a liquid fluid is linear and are symmetric along a bisecting plane. In the case of the Hydrajet™ disrupter (U.S. Pat. No. 6,269,725 by Cherry), a tall pyramidal wedge former of explosives with an angle of 90 degrees is utilized and placed inside a rectangular shaped fluid-filled chamber. Cherry proposes an adjustable apex angle and a scalability in disrupter size. Another example of a linear charge is the mod series of disrupters (U.S. Pat. No. 6,584,908). In that case, rather than a wedge, it is an arc section of a hemi-cylindrical shape. Alford et al. uses two separate water chambers and sandwiches sheet explosives between them. The jet profile is similar to the Hydrajet™ disrupter. Linear high explosive charges that drive water form blade shaped water jets. A tomographic cross sectioning of the jet would have the profile of a narrow ellipse.

Omni-directional mass jetting high explosive disrupters are good at delivering high impulse to a target and use a rod shaped explosive charge at the core of a cylindrically-shaped container. Those tools have axial symmetry. Omnidirectional tools produce low density spatial jets that particulate into droplets. Examples of these are the Mineral Water Bottle charge and the Bottler charge (U.S. Pat. No. 9,322,624). The bottler charge has three hemi-cylindrical indentations on the outer bottle surface that create a shock cavity effect and linear fluid jets at the center of each one.

Some water-based charges are more effective at perforating barriers such as liquid follow-through (LIFT) charges (U.S. Pat. No. 4,955,939). Conical LIFT charges have an air void. The explosives are rectangular prisms or right angle cylinders and oriented so that the flat face of the cylinder it abutting the water. The detonator is positioned coaxially down the center of the charge. The explosive detonation wave shock couples at the water interface producing an approximate planar shock front that travels into the water surrounding the hollow cavity causing the water to collapse into the void and jet forward. The thin plastic liner collapses on itself and flows at the leading edge of the jetting fluid. Another example of conical LIFT charge is the Rocksmith Precision Closer™ disrupter (U.S. Pat. No. 8,677,902). The cone angles are approximately 45 to 60 degrees and the jets are moving at extremely high velocities, traveling in some cases in excess of Mach 10. An example of a linear LIFT charge is the Stingray™ disrupter (U.S. Pat. No. 8,091,479 B1). LIFT charges generally produce narrow fluid jets of low mass. They have high jet stretch rates and are good barrier penetrators but yield low bulk work on media and low impulse in our testing. As a result, they are relatively poor general disruption tools.

Although improvised conical shapes are very efficient with respect to the ratio of charge mass to projectile mass (C/M), they are impractical because they have a high risk of shock initiation of an LED's main charge. We have demonstrated that a mass focusing, five-inch diameter conical shaped charge with a 60 degree apex/cone angle loaded with the lowest possible Primasheet® explosive charge will shock initiate most common propellants, which make them unacceptable for IED disruption. Standard conical shaped charges have cone angles between 45 and 80 degrees.

From the foregoing, there is a need in the art for shaped charges that can be tailored to any of a variety of applications, while also ensuring that the generated liquid fluid jet has appropriate characteristics to minimize risk of unwanted shock initiation without sacrificing target disruption capabilities.

SUMMARY OF THE INVENTION

The shaped charges provided herein address the above-discussed problems by specially designed surface shapes that support a shape-conforming explosive and that ensure a fluid is appropriately propelled from the shaped charge toward the target. This is achieved by the special geometry that can be generally described herein as a catenary paraboloid, specifically the plastic shell and facing distal end of the plastic body in which the plastic shell is positioned. The fluid immerses the plastic shell and the fluid portion between the shell surface and the distal end of the plastic body is the projectile region corresponding to liquid that will be propelled toward a target upon detonation of the explosive supported by the plastic shell surface.

Provided herein are shaped charges for focusing a fluid mass. The shaped charges are particularly suited for disrupting improvised explosive devices. The shaped charges can comprise a plastic shell having a surface with a geometric shape configured to support a shape-conforming explosive. In this manner, the geometric shape is configured to provide desired explosive characteristics on the supported explosive to force a fluid mass toward a target. The geometric shape comprises a truncated cone having an open distal end and a closed proximal end, the closed proximal end having a smoothly-curved concave shape, an outer circumference with a plurality of cut-outs radially spaced around the outer circumference. The geometric shape is axially-symmetric about a central longitudinal axis. A cylindrical plastic body has an interior volume for containing a liquid and the plastic shell, the cylindrical plastic body having: a plastic body closed distal end having a geometric shape that is substantially matched to the concave shape of the plastic shell closed proximal end; a plastic body proximal end that faces the plastic body distal end; wherein the plastic shell is concentrically positioned to the cylindrical plastic body with respect to the central longitudinal axis. A channel extends through the cylindrical plastic body proximal end and terminates at the plastic shell surface at a contact position coincident with the central longitudinal axis, wherein the channel is configured to accommodate a detonator. In this manner, a detonator can be operably connected to the shape-conforming explosive at the central longitudinal axis for precise and well-controlled detonation.

The shaped charge may further comprise the shape-conforming explosive mated to at least a portion of the plastic shell surface.

The plastic body proximal end may comprise an end cap that fluidically seals the liquid and plastic shell in the cylindrical plastic body interior volume.

The shaped charge may further comprise a detonator in a press-fit configuration in the channel and, when present, the shape-conforming explosive, to fluidically seal the liquid in the interior volume.

The shaped charge is compatible with a range of curvatures, including a concave shape that is a catenary paraboloid.

In use, the plastic shell is laterally positioned in the interior volume of the cylindrical plastic body to form a tamper region having a tamper length and a projectile region having a projectile length, wherein a ratio of the tamper length to the projectile length is between 1:1 to 2.5:1.

The cone angle can be selected from a range that is greater than or equal to 90° and less than or equal to 150°. This reflects that the invention is compatible with a range of geometries and fluid mass characteristics. For example, depending on the application of interest, including target characteristics such as barrier properties, stand-off distance, and desired fluid impact and post-impact characteristics, the cone angle, lengths, curvatures are varied. This can impact the surface area and, therefore, the amount of explosives supported by the surface.

The shaped charge is compatible with a range of interior volumes, including between 32 and 7040 fluid ounces and/or an outer diameter of between 3 inches and 25 inches.

The shaped charge may have a transition region on the plastic shell surface for smoothly transitioning from the truncated cone to the smoothly-curved concave shape. In this aspect, "smoothly transitioning" refers to a continuous slope such that there are not observable discontinuities or sharp edges on the surface.

In an embodiment, the plastic shell closed proximal end has a diameter that is between 30% and 80% of the diameter of the open end.

The shaped charges described herein may further comprise a fluid positioned in the interior volume. In an embodiment, the fluid is a highly efficient energy transfer (HEET) fluid, including any of those described in U.S. patent application Ser. No. 15/731,834 titled "DISRUPTER DRIVEN HIGHLY EFFICIENT ENERGY TRANSFER FLUID JETS" filed Aug. 18, 2017, which is specifically incorporated by reference herein for the HEET fluids described therein. Specific examples include a combination of liquid and solid particles, such that the HEET fluid combines the advantages of both water and solid projectiles as they have viscoelastic behavior and can have solid particles mixed into a fluid, including sand mixtures, and/or is a high viscosity fluid such as corn syrup, molasses or the like.

In an embodiment, the plastic body has a sidewall thickness and a front face thickness, wherein the sidewall thickness is between 2 and 4 times thicker than the front face thickness. The sidewall is optionally formed of a plastic material having a higher density than a plastic material of the front face. Examples include, but are not limited to, polyvinyl chloride (PVC), Polyterafluroethylene, Polyoxymethylene (POM) such as Delrin® plastic, phenolic Polyethylene terephthalate (PET), polyethylene terephthalate (PETE), Chlorinated Polyvinylchloride, Phenolic plastics. Similarly, sidewall relative to front face density may have a ratio up to 1.5.

The shaped charge may be further described in terms of one or more of: the truncated cone has a truncated cone angle of between 90° and 150°; the smoothly-curved concave shape corresponds to a paraboloid; and/or the truncated cone and paraboloid transition at a transition region, and the transition region is approximately tangential to both the truncated cone and the paraboloid.

The shaped charge may have an explosive weight per unit area of between 1 g/in$^2$ and 6 g/in$^2$.

The shaped charge may further comprise: a spherical projectile adjacent to the exterior distal surface of the plastic body and placed at the center of the concavity along the longitudinal axis. The spherical projectile is preferably a polyball formed of a polyurethane. The spherical projectile preferably has a spherical geometry and diameter that is between about 10% to 50% of the diameter of the plastic shell open distal end. In this configuration, the spherical projectile is physically separated from the fluid contained in the plastic body by the thickness of the wall of the plastic body distal surface.

The shaped charge has a geometric shape configured to generate a liquid jet having an annular cross-section upon impact with a target, including specifically the plastic shell surface and cylindrical plastic body closed distal end. This annular cross-section (e.g., a ring of liquid having a cylindrical outer surface) is a unique jet-shape that reduces shock impulse and thus enables the shaped charge to have twice the explosive load of comparable commercial disrupters without causing shock initiation of explosives on impact.

The shape conforming explosive is preferably a sheet explosive or a detonation cord explosive connected to a distal-facing surface of the plastic shell.

The shaped charge has a geometry configured to reduce a forward velocity gradient of a generated fluid jet. In this manner, the liquid fluid jet maintains integrity after explosive detonation.

The outer surface of the plastic body distal end preferably comprises a plurality of scores to generate petal formation, prevent cylindrical plastic body impact on the target during use and minimize risk of unwanted shock initiation. The scores may be on the outer-facing and/or inner-facing surface of the plastic body distal end. The scores may be characterized as recess features in the surface having a penetration depth. Exemplary penetration depths correspond to between 10% and 90% wall thickness, such as about 30%-60%. The exact penetration depth is variable in that the purpose of the scores is to generate structural faults, such that upon explosive motion of the liquid fluid mass, the distal end surface of the plastic body physically separates and falls apart to avoid impact force on a barrier target. Without such scoring, there is a risk of the distal end being carried along with the front face of the fluid jet and making impact on the barrier target, with attendant potential uncontrolled path in the target interior. Scoring the front face to induce petal formation of the plastic and using low density and high ductility plastic (Polypropylene, polyethylene) prevents the shaped charge body plastic from impacting at close standoffs.

Also provided herein are methods of explosively driving a fluid to disrupt an explosive target using any of the shaped charges described herein. The method may comprise the steps of: providing a shaped charge of the instant invention with a liquid positioned in the interior volume, wherein the plastic shell is immersed in the liquid; aligning the mass focusing shaped charge with an explosive target; initiating a detonation wave in the shape-conforming explosive that travels substantially parallel to the longitudinal axis, wherein the geometric shape and position of the plastic shell and the plastic body distal end are configured to generate a tamp and timing of rarefaction waves to increase a pressure duration and amplitude to drive the liquid toward the explosive target; and generating a liquid jet having an annular cross-section upon explosive target impact to reduce shock impulse and minimize risk of target explosive shock initiation. In this manner, the explosive target is disrupted.

Also provided herein are methods of making any of the shaped charges described herein, such as by forming the plastic shell and the plastic body, wherein the plastic body can accommodate the plastic shell in an interior volume, along with liquid, such that the plastic shell (and explosive supported by the plastic shell) is immersed in the liquid.

Any of the shaped charges provided herein are used with a Jet Stabilizing Projectile (JSP), including a JSP that is a spherical projectile positioned adjacent to an exterior surface of the plastic body distal end and co-axially located with the central longitudinal axis, wherein the spherical projectile has an effective density matched to an effective density of a liquid positioned in the cylindrical plastic body interior volume. The effective density of the spherical projectile may be quantitatively described as within 20% of an effective density of the liquid, including within 10%, 5%, 1%, or that is equal to the liquid effective density. The term JSP is intended to be used interchangeably with spherical projectile and/or rounded projectile.

The spherical projectile may be formed of a metal, a polycarbonate, or a composite formed of different materials. For the metal embodiment, as metals tend to have a relatively high density compared to liquid, the spherical projectile metal may be an outer layer of metal having a wall thickness, thereby forming a hollow core. This configuration is also referred to more generally as a "hollow metal". The hollow core may be filled with a filler material, including a low density material. Alternatively, the hollow core may be empty.

The spherical projectile shape and effective density may be selected such that during use the liquid and spherical projectile explosively ejected from a disrupter form a liquid jet that encapsulates 10% to 75% of an outer surface of the spherical projectile. With respect to spherical projectile shape, the parameters of interest include one or more of projectile diameter, curvature, sphericity and/or ellipticity for elliptical shapes.

The spherical projectile may also be described as being matched to the specific gravity of water (e.g., 1.0), and may be between 0.8 and 1.5, and any subranges thereof. Similar to effective density, the spherical projectile has an effective specific gravity for those embodiments where the rounded projectile is not formed of a solid unitary material, to reflect the constituents may each have a different specific gravity.

The methods provided herein may similarly relate to embodiments having a rounded or spherical projectile. For example, the method may further include the step of stabilizing the liquid jet with the spherical projectile, wherein the liquid jet flows forward around a rear surface of the spherical projectile to hydraulically stabilize the spherical projectile. As described, such methods rely on matching of the effective density of the spherical projectile to the fluid that makes up the water jet upon expulsion from the disrupter toward a target.

Any JSP may have an effective density that is within 20% of an effective density of the projectile liquid. Any JSP may have an overall shape characterized as spherical, hemispherical, spheroidal, ovoid, ogive, conical, cylindrical, parabolic, or any combination of these. The proximal portion or proximal surface of any JSP may have a shape characterized as spherical, hemispherical, spheroidal, ovoid, ogive, conical, cylindrical, parabolic, linear, rectangular, or any combination of these. The distal portion or distal surface of any JSP may have a shape characterized as spherical, hemispherical, spheroidal, ovoid, ogive, conical, cylindrical, parabolic, or any combination of these. The JSP has three primary forces acting upon it in free flight: hydraulic pressure, air pressure and gravity. The position and magnitude of these forces may be effected by the mass distribution and shape of the JSP. A JSP (optionally with fluid-jet in contact therewith) in stable flight has a trajectory such that the JSP hits the aim point (intended and aimed-at point on the target) and the trajectory of the JSP is in line (or, co-axial, or co-incident) with the projectile's longitudinal axis.

Any JSP may have a shape and/or effective density, including an effective density distribution, such that the center of hydraulic pressure of the fluid-jet on the JSP is coincident or proximate to the center of gravity of the JSP, when the fluid-jet and the JSP are in flight toward the target. In addition to the hydraulic center of pressure, any JSP may have a shape and/or effective density such that the center of air pressure of the JSP is coincident or proximate to the center of gravity of the JSP, when the fluid-jet and the JSP are in flight toward the target. In this context, "proximate" refers to a position between the centers of hydraulic pressure and center of gravity such that free flight of the JSP characteristics are improved. Optionally, the term "proximate" can be quantified as being within 2 inches, within 1 inch, or within 0.5 inches of each other. For example, the JSP can have a shape and effective density such that a center of hydraulic pressure of the fluid-jet on the JSP is coincident with or within 2 inches from a center of gravity of the JSP. Preferably, the center of gravity is distally located (e.g., is closer to the target) relative to the center of pressure associated with flow of the JSP through air. Optionally, in comparing the distance measured from the base or proximal end of the JSP, the center of hydraulic pressure of the fluid-jet on the JSP can be closer to the base or proximal end of the JSP than the center of gravity of the JSP. There are primarily three forces acting on the JSP-air pressures (center of pressure, CP), hydraulic pressure (HP), and gravity (CG).

In the absence of the hydraulic contribution, to improve free flight characteristics of the JSP, such as for flight to be stable, the CP can be behind the CG. Drag on the JSP in flight can be exploited with manipulation of the JSP geometry (shape), effective density (of liquid and/or JSP), and/or effective density distribution of the JSP, to further improve free flight characteristics and stabilize the JSP, such as by moving the CG to a more distal location on the JSP. Accordingly, any of the JSP's provided herein may be described as having, during use, a CG that is distal to the CP associated with air-flow over the JSP. The hydraulic force, generated by a liquid jet acting on the proximal end of the JSP, provides additional stability to JSP flight.

Any JSP may have a shape and/or effective density such that the center of hydraulic pressure of the fluid-jet on the JSP and the center of gravity of the JSP are collinear and on the longitudinal axis of the JSP, when the fluid-jet and the JSP are in flight toward the target.

Any JSP may have a shape and/or effective density such that the center of hydraulic pressure of the fluid-jet on the JSP is farther from the distal-most end of the JSP than the center of gravity of the JSP during the majority of the flight of the fluid-jet and the JSP toward the target.

Any of these criteria of the JSP with respect to the hydraulic pressure of the fluid-jet on the JSP and the center of gravity of the JSP, as noted above, may allow for stabilized flight. "Stabilized flight" refers to a lack of unwanted yaw, pitch or other offsetting motion such as wobble or tumbling that would tend to lead to inaccuracy. Stabilized flight may be quantitatively characterized as ensuring deviation of the target point of impact is within 6 inches or less, preferably within 3 inches or less, of the point of aim of a linear trajectory between the axial center of the mass-focusing shaped charge and the target, and is this tolerance holds for the JSP for up to or at least 20 feet toward the target.

At least a portion, or the entirety, of an outer surface of any JSP may be smooth. For example, the proximal end, or surface thereof, of the JSP may be smooth. For example, at least a portion, or the entirety, of an outer surface of any JSP may have a surface roughness characterized as having a surface roughness that, to the naked eye appears smooth. Alternatively, smoothness may refer to any recess or relief feature amplitudes that are less than 1 mm, less than 500 μm or less than 50 μm. At least a portion, or the entirety, of an outer surface of any JSP may be free of dimples, grooves, scores, channels, hollows, flutes, or any combination of these. Smoothness is also a factor in the dynamic friction coefficient of the material relative to a known surface material such as a steel and for the JSP can be in the range of 0.01-0.7. For example, a JSP can be impregnated with a lubricant. Smoothness and/or lubricant-impregnation can aid in reducing shear forces between the JSP and a target portion during its travel through target barriers and media. An example of a lubricating additive is PTFE. For polyurethane, the durometer hardness also influences the friction coefficient. For example, high durometer polyurethane in the range of 85-90 is preferred for some embodiments. Delrin™ has a low dynamic coefficient of friction. Delrin™ is in the acetal resin family of plastics, which can be used in the JSP. Also, lubricating additives such as acetal resin materials can be blended with PTFE, such as Teflon®, to greatly reduce the coefficient of friction.

Any JSP may be formed of at least one polymer material. Any JSP may comprise one or more additives; the one or more additives comprising at least one of a lubricant and a plurality of particles. For example, a lubricant is a polymer material. For example, the JSP can comprise a plurality of particles inside of the JSP, such as embedded in the JSP or positioned in a cavity of the JSP. Any JSP may comprise at least one polymer material selected from the group consisting of polyurethane, polyoxymethylene, Delrin™, silicone, nitrile, polyacetic acid, and any combination thereof. For any JSP, the distal end of the JSP may comprise an outer layer formed of a metal or other hard material; or wherein a portion of the distal end is formed of a metal or other hard material. Any JSP may comprise voids or air channels. Any JSP may be characterized by a durometer selected from the range of 60 to 90. Any JSP can have a dense material region inside of the JSP, the dense material region having a higher density than any other internal portion of the JSP. The dense material region can be a rod, for example, formed of a dense material such as one or more metals. Optionally, the dense material region (e.g., a metal rod) has a length that is 10% to 50% of the length of the JSP.

During use, the fluid-jet optionally does not encapsulate the distal-most end of the JSP during flight, but rather the fluid-jet encapsulates a proximal portion of the JSP with a trailing fluid jet behind.

Without wishing to be bound by any particular theory, there may be discussion herein of beliefs or understandings of underlying principles relating to the devices and methods disclosed herein. It is recognized that regardless of the ultimate correctness of any mechanistic explanation or hypothesis, an embodiment of the invention can nonetheless be operative and useful.

BRIEF DESCRIPTION OF THE DRAWINGS

FIG. 15A is a view of the interior volume formed by the plastic body and FIG. 15B is a view of an outer surface of the plastic body proximal end.

DETAILED DESCRIPTION OF THE INVENTION

Figure 1:
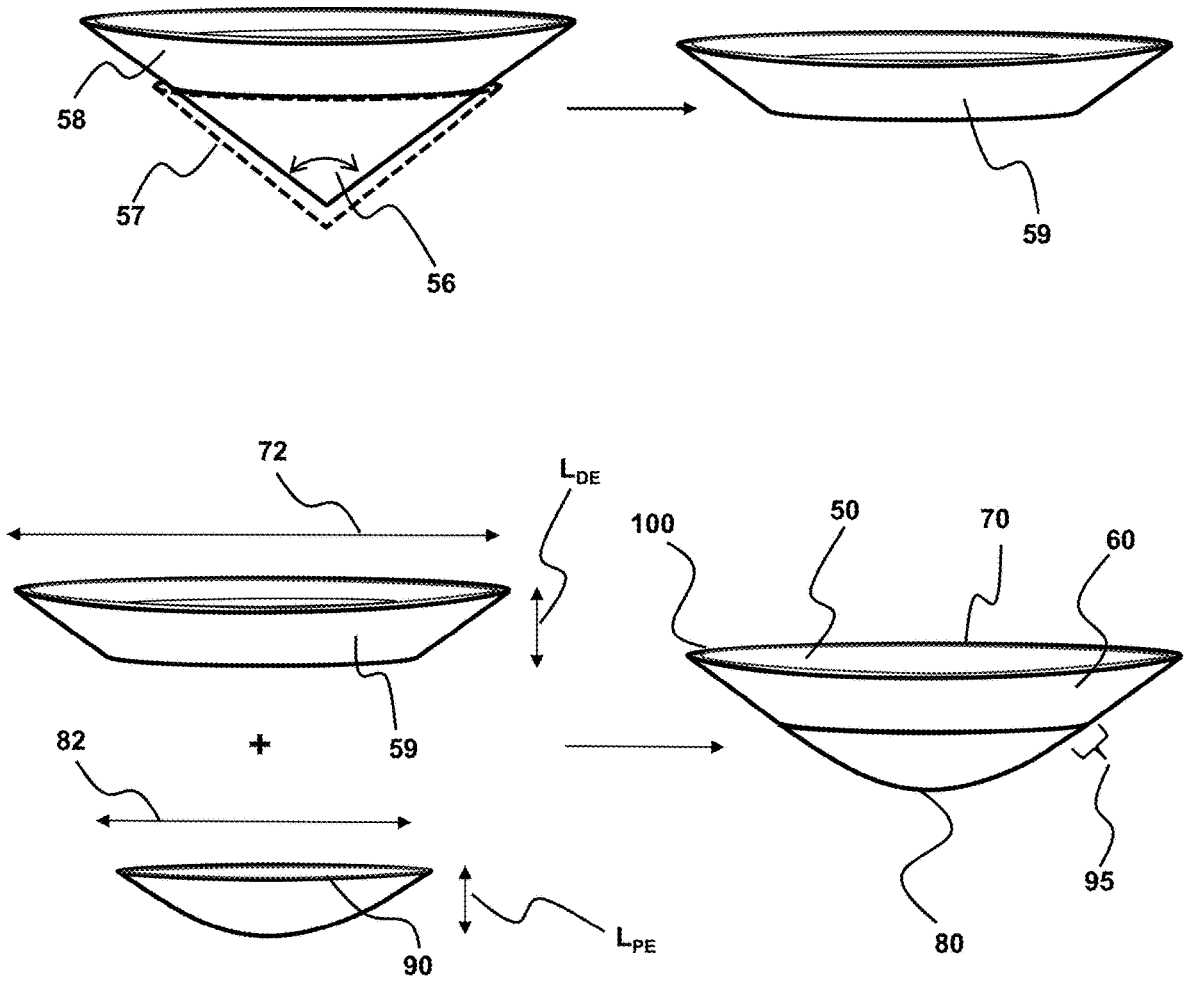
FIG. 1 geometrically illustrates a truncated cone geometric shape with an open distal end a closed proximal end having a smoothly-curved concave shape. The top panels illustrates a cone geometry that is severed at a bottom portion (indicated by dashed lines) to form a truncated cone upper portion. The bottom-left panel illustrates the addition of the truncated cone upper portion and a smoothly-curved shape to form a truncated cone having an open distal end and a closed proximal end having a smoothly-curved concave shape.

In the following description, numerous specific details of the devices, device components and methods of the present invention are set forth in order to provide a thorough explanation of the precise nature of the invention. It will be apparent, however, to those of skill in the art that the invention can be practiced without these specific details.

In general, the terms and phrases used herein have their art-recognized meaning, which can be found by reference to standard texts, journal references and contexts known to those skilled in the art. The following definitions are provided to clarify their specific use in the context of the invention.

"Fluid" refers to a liquid-based material that is contained in the interior volume of the plastic body and that immerses the plastic shell surface. The shaped charges are compatible with any number of liquids, including water and high-density liquids, such as corn syrup. As described herein and at U.S. patent application Ser. No. 15/731,874, the fluid may be a high energy efficient (HEET) fluid. The fluid may comprise solid particles suspended in a liquid medium.

"Focusing" refers to the ability to force liquid in a desired direction with desired properties related to jet formation, stability, and impact pressure or force against a target, including post-barrier penetration.

The term "substantially matched" refers to two components that are similar. In the context of a geometric shape, it refers to a deviation from absolute correspondence that does not adversely impact functional properties associated with the fluid jet and target disruption. The term is intended to reflect that the shaped charges provided herein are able to tolerate differences between surfaces (e.g., plastic shell surface and cylindrical plastic body distal end) without significant degradation in a liquid jet parameter. As desired, the term may be optionally quantitatively defined, such as curve parameters that differ by less than 10% from each other, such as curvature, distances, and any parameters associated with a corresponding curve fit, such as:

$$y = \frac{e^{ax} + e^{-ax}}{2a} = \frac{\cosh ax}{a}$$

where the parameter "a" is within 10% for each of the two best-fit curves (with surface then formed as a rotation of the function about the central longitudinal axis). In a similar manner, best-fitting of any of the curves or corresponding surfaces may be performed to define whether two surfaces are substantially matched.

Similarly, the term "match" or "matched" when used with respect to matching of effective density or effective specific gravity, refers to a difference that is sufficiently close that the desired fluid jet and rounded projectile achieve the desired jet stabilization projectile (JSP) function. Accordingly, the invention provided herein has tolerance to mismatching between effective density of the spherical projectile and the liquid, while maintain JSP function. Typically, the mismatch is within 25%, within 20%, within 10%, within 5%, within 1% or there is no mismatch. The degree of tolerance is dependent, at least in part, on the operational parameters, including liquid composition, spherical projectile composition, stand-off distance, desired penetration depth, and contact point accuracy. The more relaxed any one or more of the operational parameters, the more tolerance to density or specific gravity difference.

Unless otherwise defined, "approximately" or "substantially" refers to a value that is within 10% of a desired or true value, and can correspondingly include identically matched.

"Proximal" and "distal" are relative to the detonator and target. A distal position is further from the detonator and closer to the target than a proximal position. The terms are useful in describing relative positions of components.

The term "effective" with regard to a property such as viscosity, density, surface tension refers to an average measure of a property, including for a composite material that is formed of a combination of different materials. For example, a fluid mixture having multiple fluids and/or solid particles can be characterized as having an effective density or viscosity, which is a weighted average or bulk measure of the density or viscosity of the constituents of the fluid mixture. Similarly, a solid having different density components, such as a solid metal having a hollow interior, whether the hollow interior is empty or filled with a filler material, will have an effective density determined by the solid mass divided by the sphere volume. In this manner, a liquid's effective density will dictate, for a given material, a wall thickness depending on the material's density. Furthermore, the matching can be visually confirmed by placing the projectile in the liquid; if the projectile settles or floats to the top overly quickly, the projectile and liquid are mismatched. In contrast, if the projectile does not vertically move substantially, the projectile and liquid are characterized as being matched. For example, lower density metal shells can have thicker wall thickness compared to higher density metal shells, while maintaining effective density matching with the liquid. An equation governing this relationship is:

$$((4/3\pi((D/2)^3-((D/2)-W)^3)*\text{metal density})/V_T=\text{liquid effective density} \quad \text{Eq. (1);}$$

where D is sphere diameter, W is wall thickness, and $V_T$ is sphere total volume. For exact mathematical identity, the effective densities are exactly matched. For a 20% or less difference inequality (e.g., left side is different from right side of equation by 20% or less), the matching is 20% or less; etc.

In this manner, metal spheres can be used instead of polyballs, even though the density of metal tends to be significantly higher for a metal than a plastic or rubber sphere. The wall thickness and material in the hollow core region are appropriately selected.

The invention can be further understood by the following non-limiting examples.

Example 1: Shaped Charge Theory and Application

The Catenary Advanced Technology (CAT) disrupter is a mass focusing shaped charge that explosively drives a large volume of water, or other liquid such as Highly Efficient Energy Transfer (HEET) fluid as described in any of U.S. patent application Ser. No. 15/731,874, U.S. Pat. No. 10,451,378, U.S. Pub. No. 2020/0025508 each to Vabnick et al. The liquids jet at relatively high velocity to disrupt improvised explosive devices (IEDs). The jet may perforate the barrier(s) of a bomb, destroys fuzing components and causes separation of the firing train to include expulsion of the explosive main charge. The CAT disrupter has an axially symmetric geometry. The plastic shell that shapes the explosives (also referred herein as an HE former) is a hybridization of a truncated cone at the opening which transitions to a smooth-curved surface such as a parabola at the closed end. Sheet explosives are mated to the surface of the HE former. An enhanced water charge (EWC) was previously developed using a plastic bowl lined with sheet explosives or lined with overlapping wraps of detonation cord. As with all mass focusing shaped charges, the CAT disrupter uses a Mach-stem effect to cause a higher pressure field along its axis of longitudinal symmetry. The water near the center is accelerated more than the water in the periphery. The CAT disrupter fluid jet tip can be explosively propelled in a range from transonic to supersonic velocities. The jet velocity can be controlled by the amount of explosives applied to the explosive former or by modifying disrupter geometric parameters to include cone angle and tamper mass-to-projectile mass ratio. Due to the HE former's parabolic base, the water is collimated and has a greatly reduced forward velocity gradient (FVG) compared to other mass focusing charges. This results in unprecedented penetration and effective working distance. The CAT shaped charge can disrupt IEDs up to four times farther than other fluid mass focusing disrupters of comparable size. Modification of the cone angle can also be used to change the jet profile including the cross sectional area at any point along its length.

The previous EWC improvised mass focusing disrupter used a plastic food storage bowl to hold a large volume of water that was driven at high velocity and formed jets over short distances. That EWC tool was good at mass expulsion of an IED main charge, a desirable characteristic of any IED disrupter. The bowl had a scalable and consistent shape; its structure had a flat bottom and curved sides. The rim diameter was generally 50% larger than the base. Unfortunately, the EWC had a large explosive charge mass to fluid mass ratio (C/M). That EWC required a considerable amount of explosives to perform its function, which is about three to four times the explosive quantity used inside an instant CAT disrupter of comparable size. That EWC lacked a tamper due to the complexity of construction and had a flat face which was made from the bowl lid. As described herein, however, a flat disc shaped lid adds to the inefficiency of the charge. With the advent of CTH hydrocode modeling (Sandia National Laboratories), computer-aided design, and 3D printing, developing complex geometries to dramatically increase efficiency and performance of mass focusing water charges became possible and all these technologies are used in concert to create the instant CAT high explosive shaped charge. The CAT disrupter drives a jet of water in roughly a right angle cylinder profile that is notably longer than most disrupter jets and, as discussed herein, can have an annular cross-section upon target impact. The reduced FVG makes it very stable in flight having an effective working distance of two to three times that of current commercially available mass focusing high explosive disrupters.

One embodiment of the CAT disrupter has a container volume of approximately 64 ounces and drives a water slug that is 5 to 10 times the volume of the water projectile in a propellant-driven water cannon/dearmer such as the percussion actuated non-electric (PAN) disrupter (U.S. Pat. No. 4,957,027) or similar dearmer.

The CAT disrupter jet profile in cross section is similar to the jet formed by the PAN with the Reverse Velocity Jet Tamper (ReVJeT) disrupter enhancer adapter (U.S. Pat. No. 10,451,378). The CAT disrupter average jet cross sectional area is significantly larger and travels at higher velocity. Using the maximum explosive load tested, the velocity of the CAT disrupter jet tip averages five times faster than that of a PAN jet.

Several inefficiencies in mass focusing explosive shaped charges were minimized in the design of the CAT disrupter. A dominant destructive hydrodynamic factor in all mass focusing high explosive tools is the FVG. The jet will break up into droplets or particles, thus losing the jet's effective density and its ability to transfer momentum and energy. The FVG can be explained qualitatively by dividing the jet into discrete elements. Proceeding from the rear of the jet to its front, each element is progressively faster. The rate of jet stretch increases with explosive load. The FVG can be complex and may not be linear. The jet stretches apart by this hydrodynamic stress. Atomization also occurs from the turbulence inside the jet and air drag along its front and sides. The CAT disrupter FVG is considerably reduced compared to other disrupter high explosive shaped charges described herein.

The CAT disrupter can also be used to drive HEET fluids (U.S. patent application Ser. No. 15/731,874 titled "High Energy Efficient Transfer Fluids" filed Aug. 18, 2017). There are experimentally demonstrated advantages which show that higher density liquids have improved penetration, notable increases in bulk work and momentum transfer and, due to their higher mass, can lower jet velocities. The latter is important when impact sensitive explosives are present inside an IED. Due to the hydrodynamic characteristics of the jet, the impact pressures have a squared dependence with jet velocity. The shock Hugoniot properties of the HEET fluids also may contribute to the reduced risk of shock initiation of explosives inside an IED when they are impacted by a disrupter jet.

Provided herein are CAT disrupter conical regions having an apex angle greater than 90 degrees and less than 150 degrees. One embodiment uses a 109 degree angle which results in the maximum water volume to minimum surface area of the conical zone, thus minimizing the amount of sheet explosives in the charge. The base region of the CAT disrupter is parabolic and not conical. This shape is repeated on the front shock wave shaper; however, rather than having a discrete transition, the curve is tangential to the linear region of the cone so there is a smooth transition between these regions. The diameter of the parabola is 50% of the diameter of the conical belt's rim. The explosives of the CAT are back-tamped with water to increase the duration that the pressure is sustained and peak pressure for a given explosive charge mass. The velocity range of the CAT disrupter can be transonic using the minimum thickness Primasheet® flexible sheet explosive and supersonic with the maximum load tested. This velocity range makes it ideal for the Counter-IED mission by controlling impact pressures using a spectrum of velocities. We have demonstrated that the CAT disrupter jet can be driven with twice the explosive loads of comparable-sized commercial disrupters without causing shock initiation of impact sensitive explosives. Hydrocode modeling reveals an annular jet tip in cross section. The reduced area of impact and jet bunching help reduce the shock impulse.

A detonator is coaxially seated in contact with charge apex and initiated. The resultant detonation wave shock couples into the water and shock waves move inside the fluid. Due to shock impedance at the water-container interface, the shock rarefaction waves reflect back into the water slug which can further contribute to water movement. In one embodiment of the CAT disrupter, the sidewalls of the fluid container were three times thicker than the front face and used higher density PVC compared to the front face which was made from ASA material. Tests of CAT disrupters constructed from uniformly thick ASA sidewalls and front were less efficient at penetration and impulse than the CAT disrupter embodiment using a thick PVC side wall. Provided is a method of using inertial confinement and shock impedance to increase the efficiency of the CAT disrupter. Thus, PETE plastic on the side wall can further improve the efficiency of the CAT disrupter given it is of higher density than PVC. PVC and PETE are 1.35 and 1.5 times the density of ASA, respectively.

We observed that thickening the wall on the front face of the charge and using a high strength, brittle plastic had negative effects on performance. High explosive disrupters whose front surface are made from low ultimate tensile strength and high tensile elongation plastics such as low density polyethylene (LDPE), high density polyethylene (HDPE), or polypropylene (PP) should have better performance with respect to jet velocity, penetration and impulse. Wall thicknesses between 0.02 inches and 0.08 inches result in good performance. Brittle plastics that have similar densities to water fracture into particles that travel along with the jet and resulted in explosive initiation on impact with targets filled with common explosives.

Due to difficulty in manufacture, most commercial mass focusing high explosive charges have flat fronts, which may cause cavitation bubbles inside the water slug that forms the jet. Shock waves can cause tensor stress regions within the water. These extreme low pressure zones may result in cavitation and the water boiling at room temperature. The gas bubble formed can interfere with jet formation. For these reasons, any of the shaped charges provided herein do not have a flat front (distal end). The CAT disrupter has a front (plastic body distal end) that is coaxially aligned with the explosive former (plastic shell distal end) and of similar geometry: a truncated cone at the opening which transitions smoothly to a parabola at the closed end. This is referred herein as "substantially matched" surfaces. CTH modeling shows shaping of the water-air boundary causes the rarefaction waves to dissipate in amplitude with distance from the front surface of the charge and thus minimizes the cavitation effect. The front face of the CAT disrupter is, therefore, also referred to as the rarefaction wave dampener. It is a mild indentation compared to what is seen on LIFT charges, but likely contributes to jet formation.

The CAT disrupter explosive cone angle compatible with various angles, with the specific angle selected to achieve a desired jet velocity, jet length, and jet diameter. A sectioning of the CAT formed jet reveals an annular cross section toward and at the jet tip. The CAT disrupter is geometrically scalable. Examples include two sizes, a 64-ounce volume and an approximately 150-ounce volume. When geometric scaling is used, the 150-ounce disrupter is predicted, with the appropriate explosive scaling, to have a 33% increase in penetration and impulse and a 60% increase in bulk work compared to the smaller disrupter. In addition, the geometrically scaled larger disrupter will produce the same jet velocity as the smaller disrupter. This means the impact pressures and thereby the risk of shock initiation on impact of explosives will be similar. The CAT charge diameters can be scaled down to 3" or scaled up to 25". We can limit the largest size to be that of a 55 gallon drum to use as a general disruption tool against vehicle borne IEDs. The smallest CAT disrupters have tactical applications for dismounted operations or for precision disablement of specific components inside of a bomb.

Controlling the velocity of the jet balances performance with the negative result of shock initiation of target IED explosives due to impact pressures. The jet tip velocity and the jet velocity profile with respect to jet length are manipulated in several ways in the CAT disrupter. Several structural manipulations can accomplish the goal of keeping the velocity of the jet below critical levels that cause shock initiation of explosives on impact. The CAT disrupter parabolic region curvature can be flattened and the cone region angle can be increased to reduce velocity and this also has the benefit of increasing jet diameter. The CAT ratio of tamper region length to projectile region length can also control the jet tip velocity and the ratio can be 1:1, 1.5:1, 2:1 and 2.5:1, and any sub-ranges thereof. Geometrically scaling the disrupter, but not the explosives weight per unit area inside the disrupter, is another method to reduce the jet velocity. Scaling the CAT disrupter such that the diameter ranges from three inches to 25 inches. Changes in net explosive weight and fluid density can also be used to reduce velocity. Furthermore, HEET fluids can be used to increase density. The Hydrajet™ disrupter (U.S. Pat. No. 6,269,725) describes use of clay as a material of higher density, but for the purposes of increasing penetration rather than reducing velocity. The CAT disrupter explosive weight per unit area can be adjusted from 1 gram per square inch to 6 grams per square inch which results in comparable velocities of the PAN water jets to five times the PAN water jet.

During our testing of current commercial mass focusing high explosive charges, their nominal standoffs are approximately one charge diameter. However, increasing the distance from this standoff results in a dramatic loss in momentum transfer and penetration. The CAT disrupter provided herein is the first disrupter tested that increased penetration with standoff to two charge diameters. Furthermore, there was not a significant loss in moment transfer at this farther distance. This improvement is due to the normalized velocity profile within the jet. The effective working distance of the jet did not drop with double the standoff. The hole diameters in layered barriers perforated by the jets were reduced which can be explained by the jet stretching. Accordingly, the shaped charges described herein may be used to increase stand-off distance, including up to and including two charge diameters. Tests using higher explosive weights, showed the CAT disrupter is effective at standoffs up to 12 charge diameters.

Due to the normalized velocity profile of the CAT jet, a high strength, high durometer (80-90) polyurethane ball can be placed at the axial center of the shock wave dampener. The ball can be used as a jet stabilizing projectile (JSP), including a projectile described in any of U.S. Pat. App. No. 62/884,961 filed Aug. 9, 2019 and corresponding Ser. No. 16/987,942 titled "Fluid Jet Stabilizing Projectile for Enhanced TED Disrupters") and Ser. No. 17/138,661 filed Dec. 30, 2020 titled "Rounded Projectiles for Target Disruption", each of which are specifically incorporated by reference herein, specifically for the rounded projectiles disclosed therein, and behaves similarly to the JSP used with the PAN disrupter and ReVJeT adapter. The common aspect is that the rounded projectile (e.g., ball or sphere) has an effective density or effective specific gravity that is matched to the liquid positioned in the cylindrical plastic body interior volume to achieve fluid jet stabilization during use, and attendant stabilization of the ball flight path. Based on the predicted jet tip shape being annular, it will promote hydraulic trapping of the ball, including a polyurethane ball, a metal ball, or a metal ball having a core open volume or a core portion that is formed of a lower density material. The ball seats inside the hollow region of the jet and is trapped by the jet due to its flow properties. The ball will cause a slip stream such that air drag is reduced around the jet tip and a low pressure zone behind the ball will cause the water to flow forward around the rear surface of the ball creating hydraulic stabilization of its flight. The advantages of a JSP for bomb disablement is increased barrier limit thickness and the reduced surface area on impact which is known to lower shock impulse as previously described. Polyurethane has similar shock Hugoniot properties as water and thus reduces the risk of shock initiation of explosives due to shock impedance. The JSP should be 10% to 50% of the CAT container diameter to produce the air drag benefits. In comparison, Rock et al. (U.S. Pat. No. 8,677,902) propose using a small metallic bead in the apex of the hollow void (shock cavity) of their LIFT charge. They propose the small bead material to be copper, steel, lead or depleted uranium, which are at least nine times the density of water. The small bead is explosively driven forward, but does not ride the jet tip. There is an extreme forward velocity gradient in a conical LIFT and the metal bead would not behave like a JSP.

Example 2: Geometrical Configurations

Figure 6A:
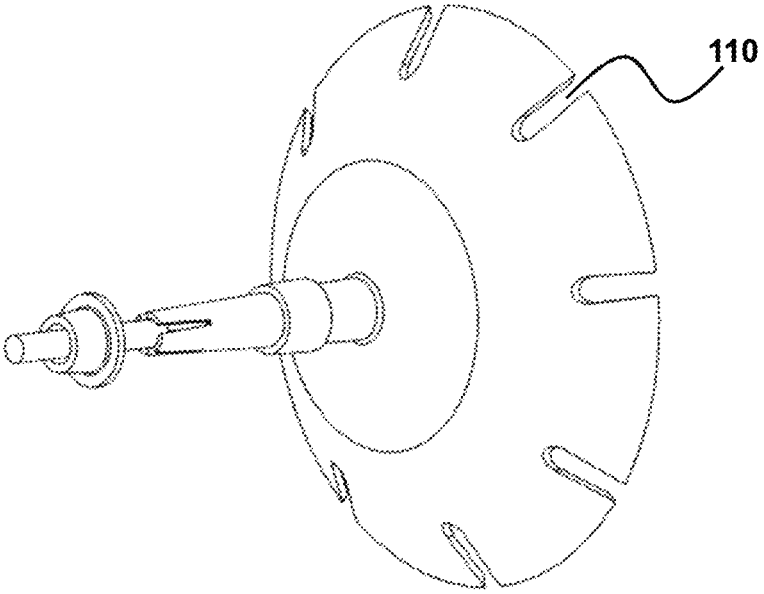
FIG. 6A illustrates the plastic shell (back-side of concave surface) with detonator inserted with a compression fit detonator lock.
Figure 6B:
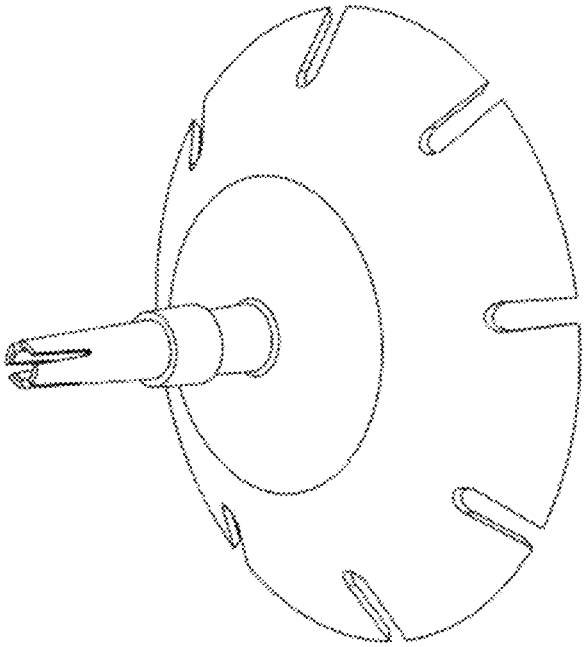
FIG. 6B illustrates the shell without the detonator.
Figure 7:
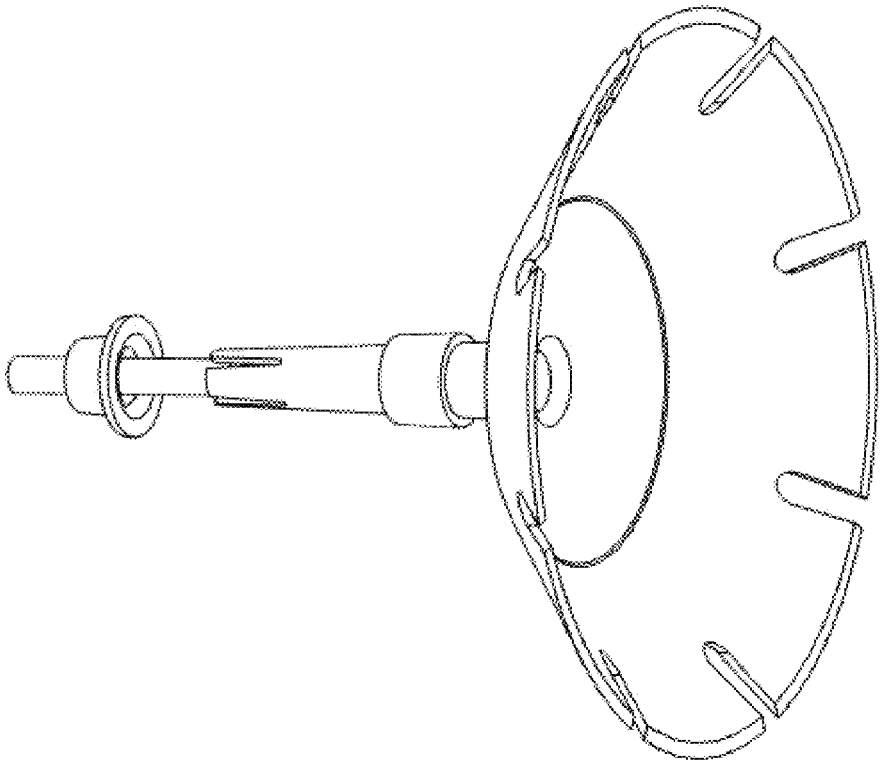
FIG. 7 corresponds to FIG. 6A except with a view of the truncated cone of the plastic shell surface with the smoothly-curved concave shape.
Figure 8:
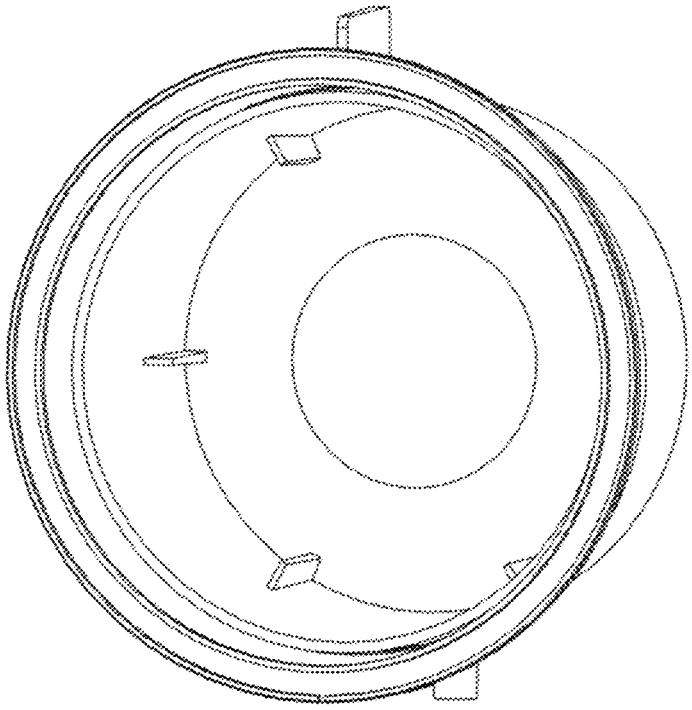
FIG. 8 is a view of the cylindrical plastic body interior volume.
Figure 9A:
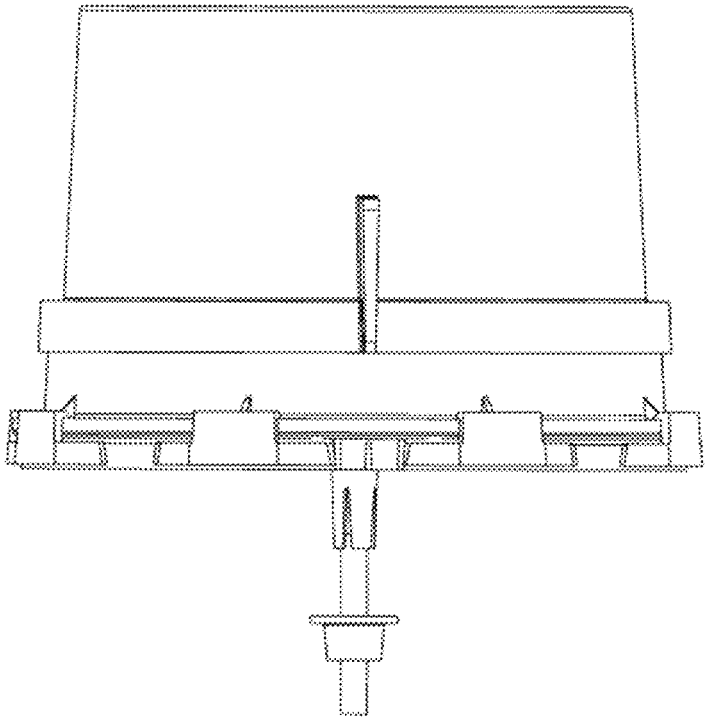
FIGS. 9A and 9B illustrate the CAT top and bottom view, respectively.
Figure 9B:
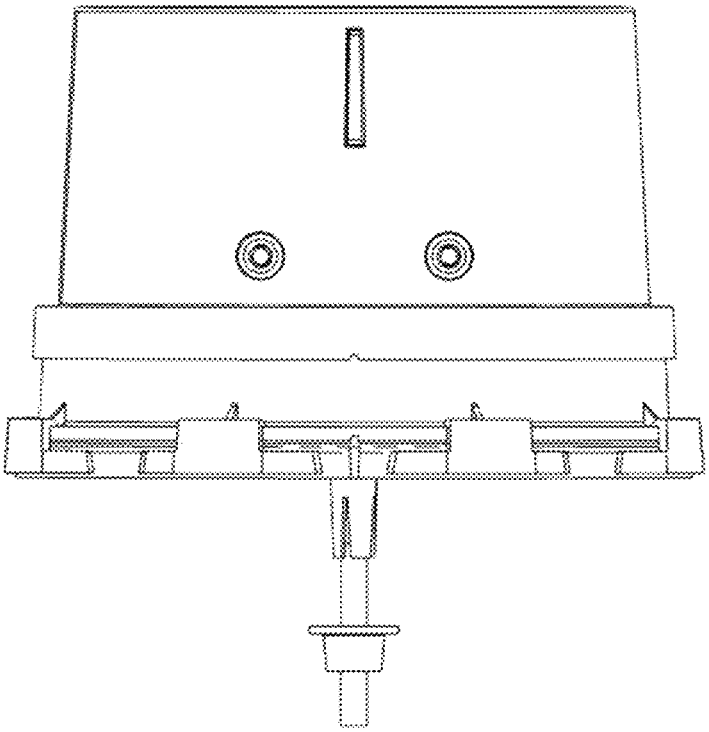
Figure 19:
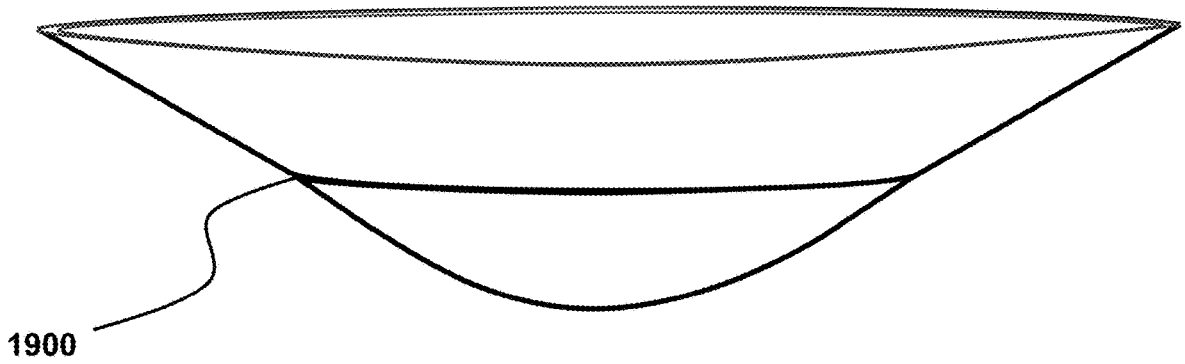
FIG. 19 illustrates another geometric shape of the plastic shell, a truncated cone-catenary that is not tangential at the profile transition point 1900.

The plastic shell is specially configured to have a desired geometric shape to achieve the desired functional benefits described herein with respect to a subsequently generated fluid projectile. FIG. 1 illustrates, in terms of geometrical shapes, a truncated cone 60 geometric shape with an open distal end 70 a closed proximal end 80 having a smoothly-curved concave shape 90. The top panels illustrates a cone geometry 58 having a cone angle $\alpha$ indicated by element 56 that is severed at a bottom portion (indicated by dashed lines 57) to form a truncated cone upper portion 59. The bottom-left panel illustrates the addition of the truncated cone upper portion 59 and a smoothly-curved shape 90, connected at transition region 95, to form a truncated cone 60 having an open distal end 70 and a closed proximal end 80 having a smoothly-curved concave shape 90 with an outer circumference 100. The shaped charges provided herein, however, are compatible with transition regions 1900 that may be less smoothly transitioned, such as non-tangential transition region 1900 as illustrated in FIG. 19. The open distal end 70 has diameter as reflected by arrow labeled 72 and closed proximal end 80 has diameter as reflected by arrow labeled 82. As desired, a plurality of cut-outs 110 may extend from the outer circumference toward the central longitudinal axis 120, as illustrated in FIGS. 6A-6B.

Views of the outer surfaces of the shaped charge, specifically the cylindrical plastic body, are provided in FIGS. 3A-5, 9A-10 and 15B. Views of the plastic shell are provided in FIGS. 1, 6A-7 and 11A. Views of the combination of the plastic shell and body, or views of the interior aspects of the plastic body, are provided in FIGS. 2, 8, 12-15A.

Figure 2:
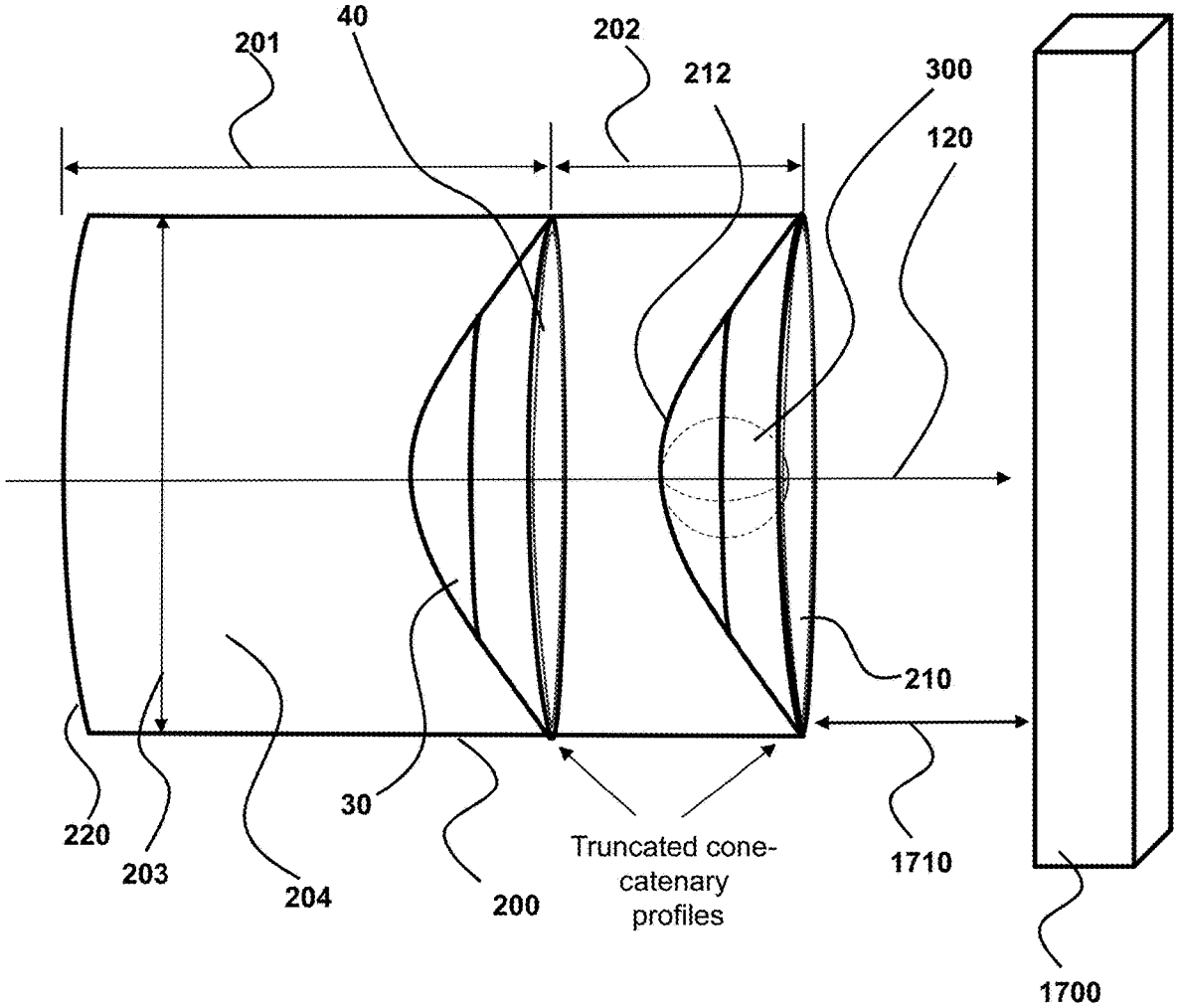
FIG. 2 is a schematic overview of the plastic shell concentrically positioned with respect to the cylindrical plastic body.

FIG. 2 illustrates plastic shell 30 with a plastic shell surface 40 having a geometry generally corresponding to that of FIG. 1, positioned in cylindrical plastic body 200. The plastic shell surface provides support to a shape-conforming explosive 150 (FIG. 11B). The invention is compatible with a range of shape-conforming explosives, including a sheet that conforms to the surface or a cord-type explosive that is laid along the shell surface 40. Plastic body 200 has a closed distal end 210 and a proximal end 220. The ends 210 and 220 face each other and are separated by a separation distance defined as the sum of the tamper length Lt (201) and projectile length $L_p$ (202). The separation distance and the effective diameter 203 of the cylindrical plastic body define interior volume 204. The plastic shell 30 is concentrically positioned to the cylindrical plastic body 200 with respect to the central longitudinal axis 120. Optionally, a spherical projectile 300 is positioned at the end 210 and adjacent to the exterior surface 212, in a co-axial configuration. The spherical projectile is placed in contact with the surface at the deepest point in the concavity on the cylindrical plastic body closed distal end.

The position of the shell surface 40 along the central longitudinal axis can be adjusted by changing the length of the plastic shell 30 stem 42 that accommodates channel 250 for the detonator 260.

Figure 3A:
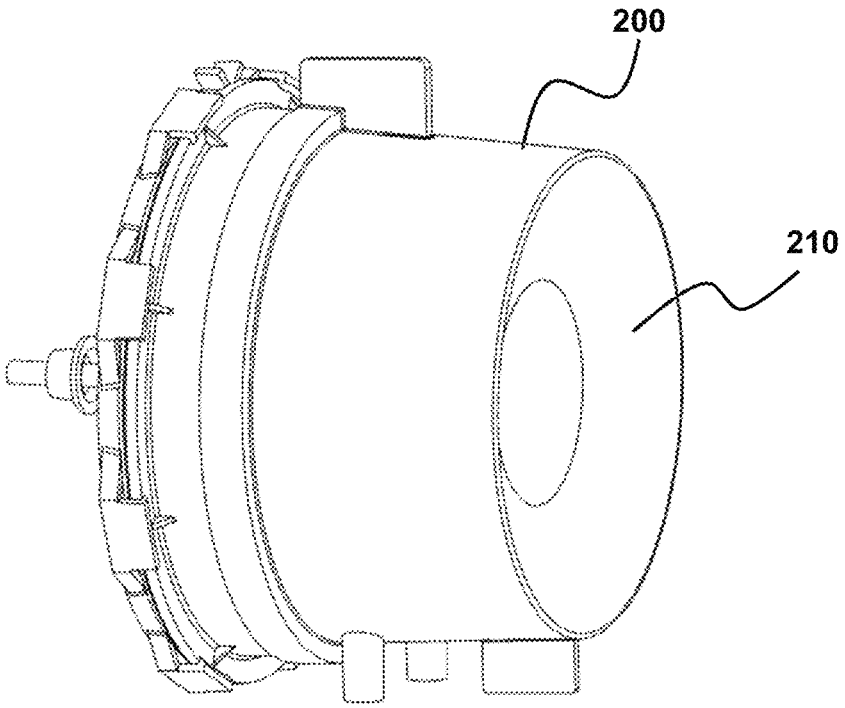
FIGS. 3A and 3B illustrate the assembled CAT front (plastic body distal end) and back (plastic body proximal end) isometric views, respectively.
Figure 3B:
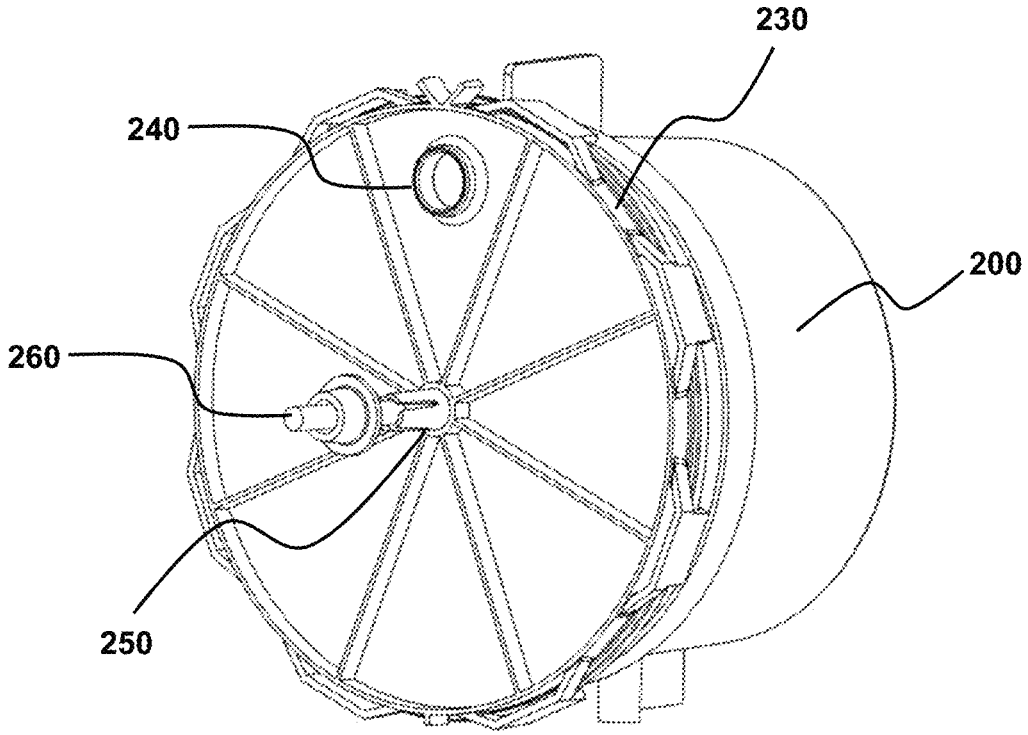
Figure 4:
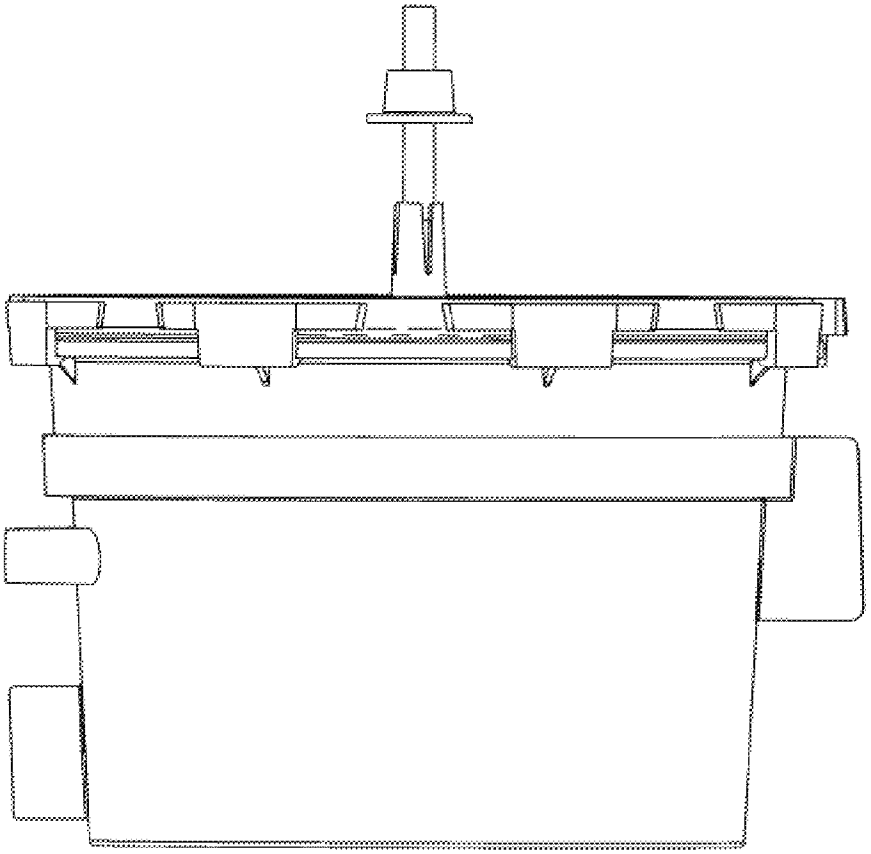
FIG. 4 illustrates the assembled CAT side view.
Figure 5A:
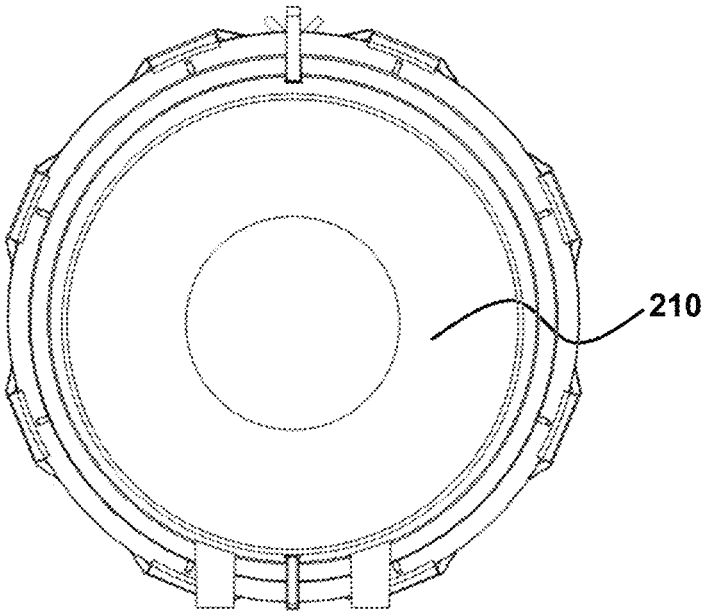
FIGS. 5A and 5B illustrate the CAT front (plastic body distal end) and back (plastic body proximal end), respectively.
Figure 5B:
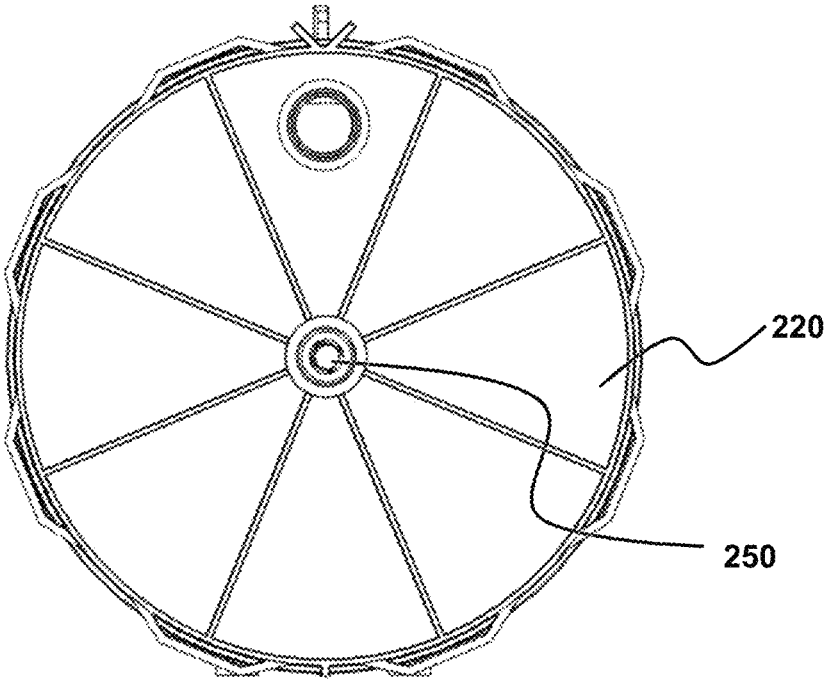

FIG. 3A-3B are perspective views of the cylindrical plastic body 200. FIG. 3A illustrates the cylindrical plastic body closed distal end 210 has a geometric shape corresponding to the plastic shell surface 40 (see, e.g., FIGS. 2 and 7). The shaped charge can have an end cap 230 to provide access to interior volume of body 200 for positioning of plastic shell 30 and explosive 150. A liquid port 240 may traverse a wall of the plastic body for introducing and filling the body internal volume with liquid. In an embodiment, the liquid port 240 may traverse through the end cap 230. Once the liquid is introduced, the liquid port may be plugged with a plug or the like to ensure fluid does not leak out of the shaped charge. Alternatively, the liquid may be introduced directly to the plastic body interior volume, and then sealed with an end cap. The end cap may be connected to the plastic body by any number of means in the art, including by rotational mating of threads and grooves, snap-fit, clamp-fit, friction fit, and/or adhesive seal.

Figure 11A:
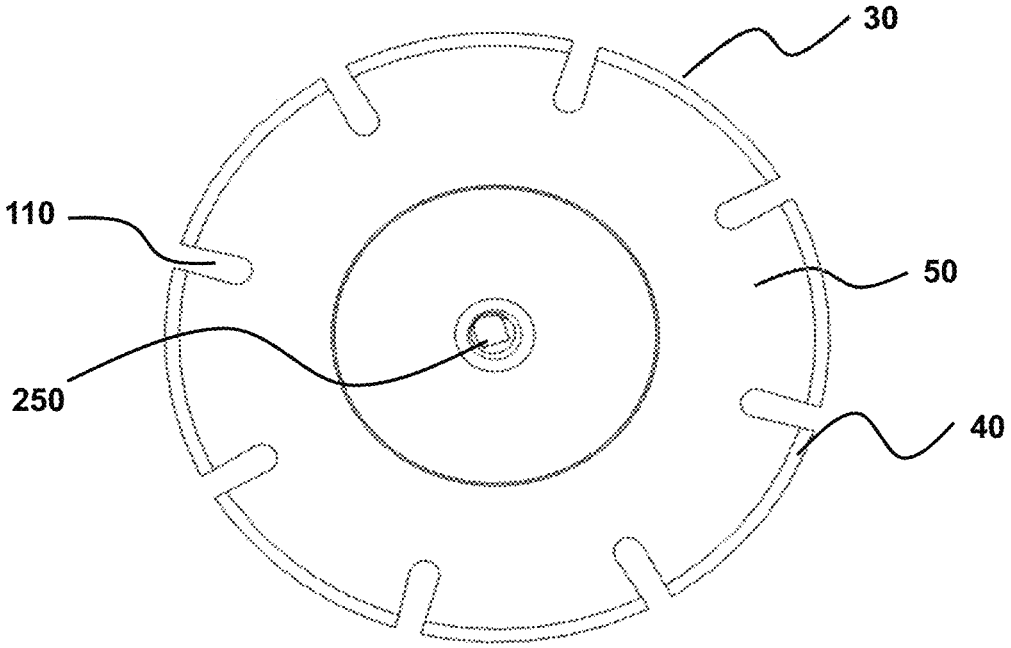
FIG. 11A is a view of the plastic shell surface ready to receive a shape-conforming explosive.
Figure 11B:
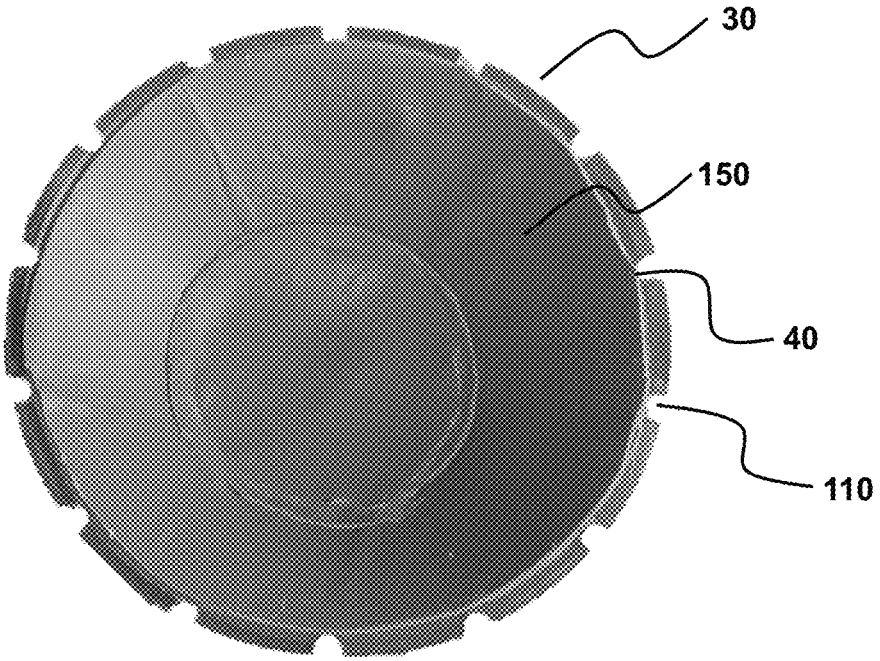
FIG. 11B illustrates a shape-conforming explosive (C4 Primasheet® explosive) mated to at least a portion of the plastic shell surface.
Figure 12:
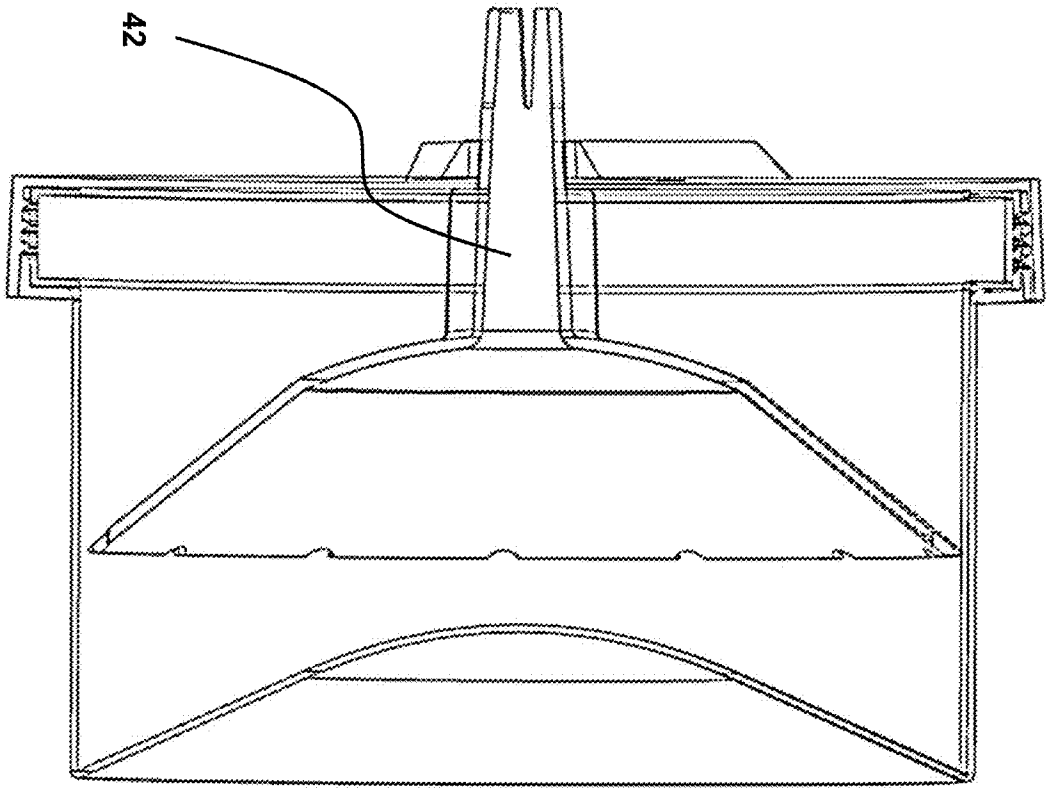
FIG. 12 is an open side view of an assembled shaped charge.
Figure 13:
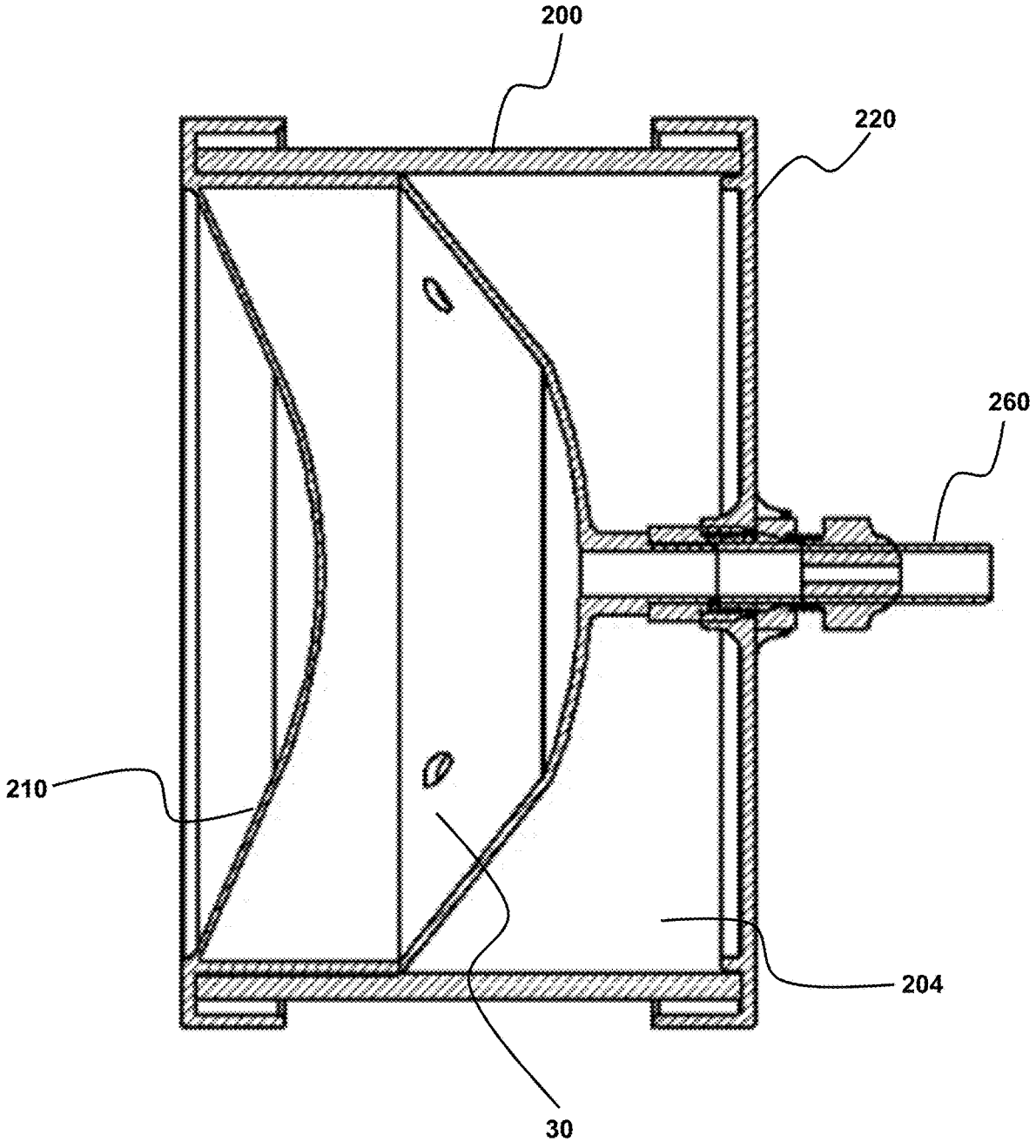
FIG. 13 illustrates a thicker and denser body side wall of FIG. 12, with a true right-angle cylinder plastic body.
Figure 14A:
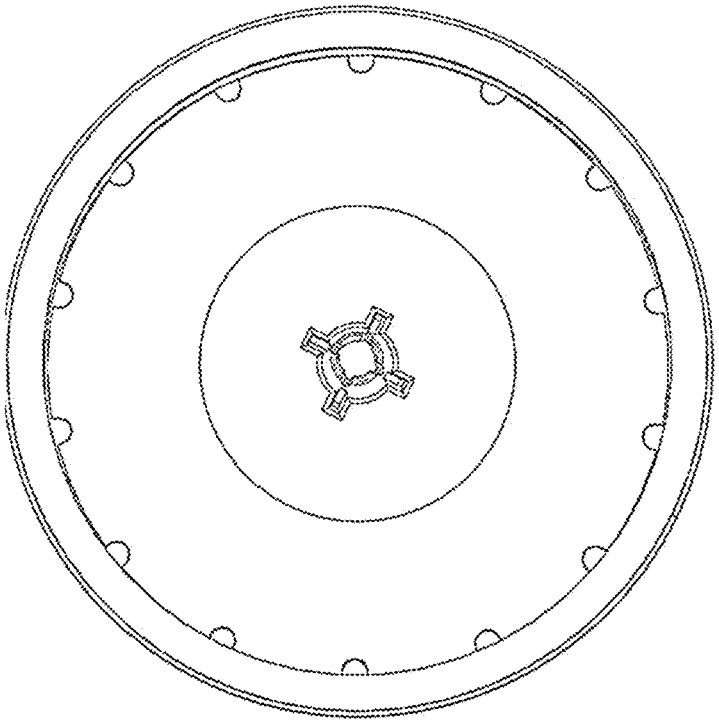
FIGS. 14A-14B illustrate the CAT without end cap.
Figure 14B:
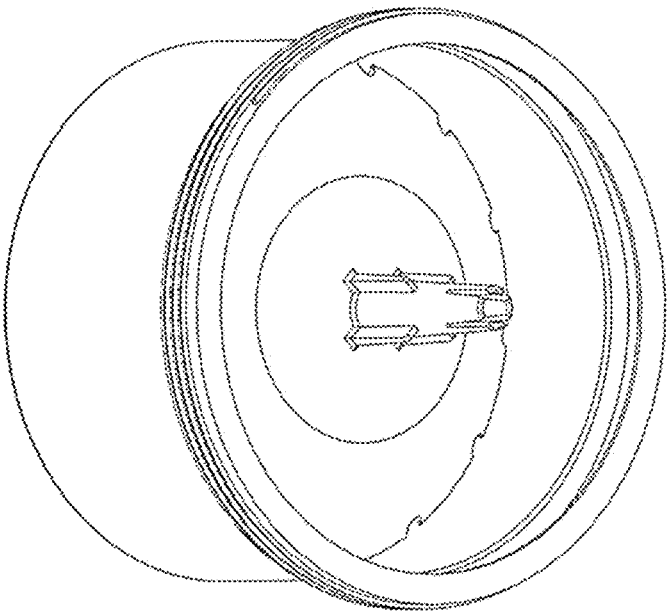
Figure 15A:
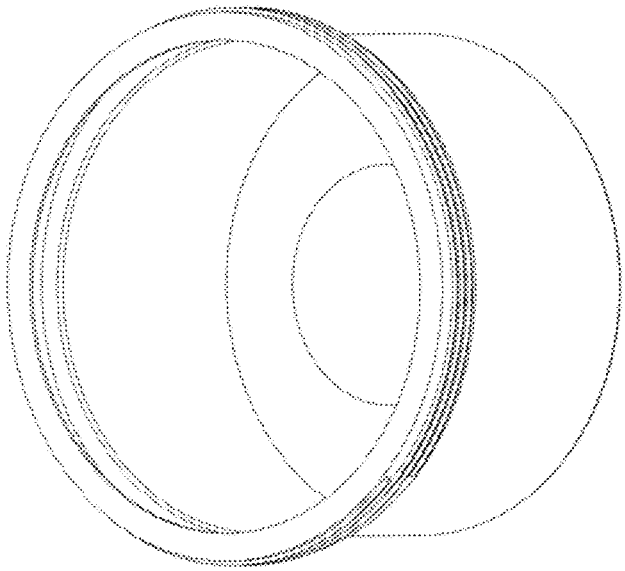
FIGS. 15A-15B are different views of FIGS. 14A-14B but with the plastic shell (e.g., High Explosive (HE) former) removed.
Figure 15B:
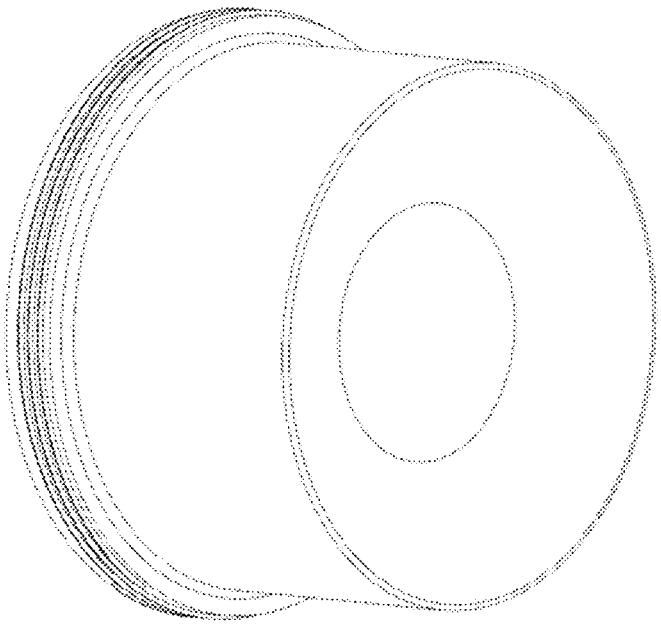

A channel 250 is configured to operably connect to a detonator 260 for detonating shape-confirming explosive 150 that is at least partially mated to plastic shell surface 50 (see, e.g., FIG. 11A (illustrating plastic shell surface 40 with distal-facing surface having a geometric shape 50 ready to receive shape-conforming explosive 150) and 11B (illustrating shape conforming explosive 150 mated to at least a portion of surface 40 of plastic shell 30).

Referring to FIGS. 1, 7, 12 and 13, the plastic shell 30 has a specially configured surface to ensure appropriate forces on the liquid fluid 20 contained in the in interior volume 204 of the cylindrical plastic body 200 upon detonation of explosives supported by the plastic shell surface. This is achieved, at least in part, by positioning a shape-conforming explosive on the plastic shell surface, wherein the plastic shell surface has the desired three-dimensional geometry. The plastic shell surface is concave-shaped. More preferably, the concave-shaped surface is a "catenary paraboloid", such as generally illustrated in FIG. 1. The curve of the proximal end 90 of the surface is superficially similar in appearance to a paraboloid, but is more accurately a smooth curve, including a portion of a spheroid or that is U-shaped and is described herein as catenary. It can be generally approximated as a surface formed from revolution of a portion of a hyperbolic cosine function. As described in FIG. 1, a distal portion of the plastic shell surface 40 is a portion of a cone, referred herein as a "truncated cone". The longitudinal length ($L_{PE}$) of the proximal end 90 relative to the longitudinal length ($L_{DE}$) of the distal end of the cone-truncated upper portion 59 (($L_{PE}/L_{DE}$) is selected depending on the application of interest, and can be $0.1<L_{PE}/L_{DE}<0.9$, with particularly preferred ratio around 0.5.

As illustrated in FIG. 2, the plastic shell is laterally positioned relative to the ends of the plastic body to form a tamper length 201 and a projectile length 202. The ratio of tamper length (201):projectile length (202) is selected depending on the application of interest and attendant desired fluid jet characteristics, including with respect to type of target 1700, fluid mass properties, and stand-off distance 1710.

Figure 10:
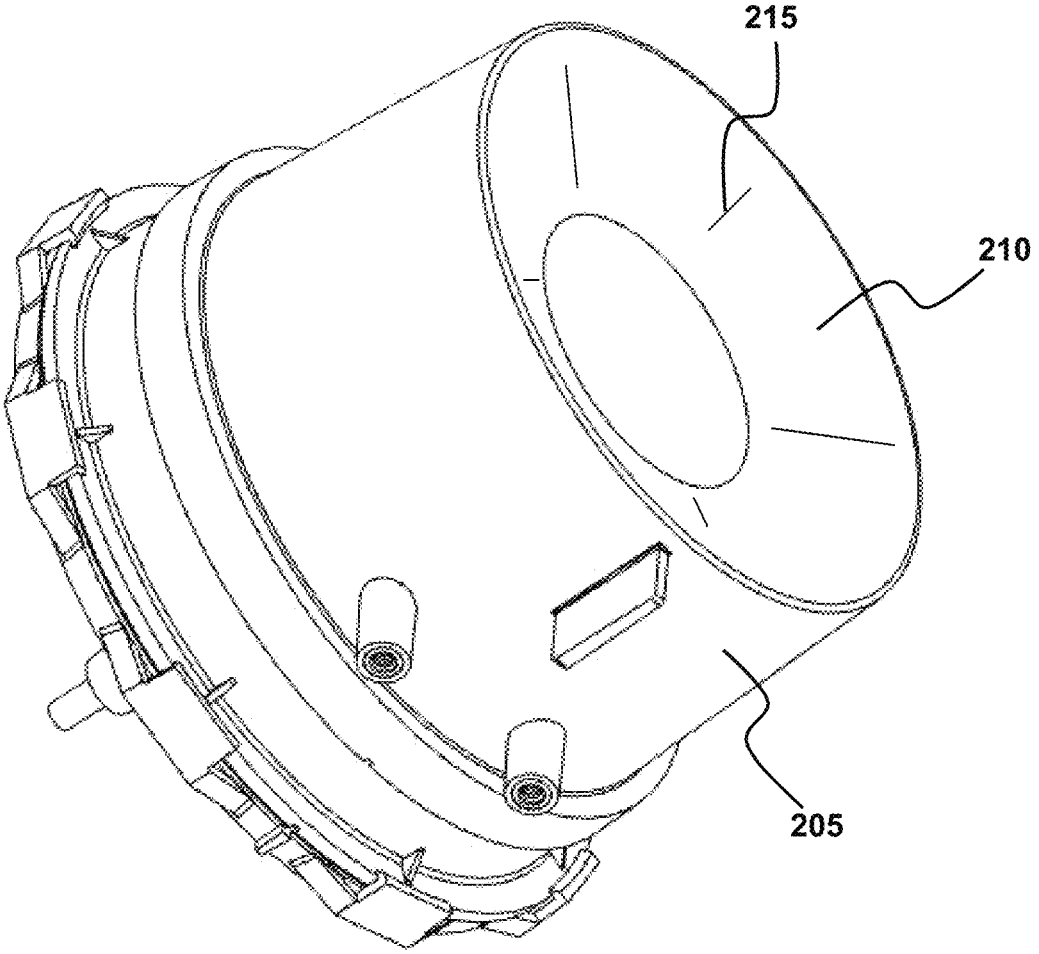
FIG. 10 illustrates the CAT bottom isometric view.

FIG. 10 is a view of a shaped charge outer surfaces, including cylindrical plastic body 200 having sidewall 205 and front face 210 (also referred herein as cylindrical plastic body closed distal end) 210, each having an independently selected thickness. Sidewall 205 may comprise PVC plastic. Optionally, the plastic body distal end 210 has one or more scores 215 to facilitate, after detonation, well-controlled separation of the distal end to further reduce risk of unwanted detonation.

Example 3: Fluid Jet Characteristics

Figure 16:
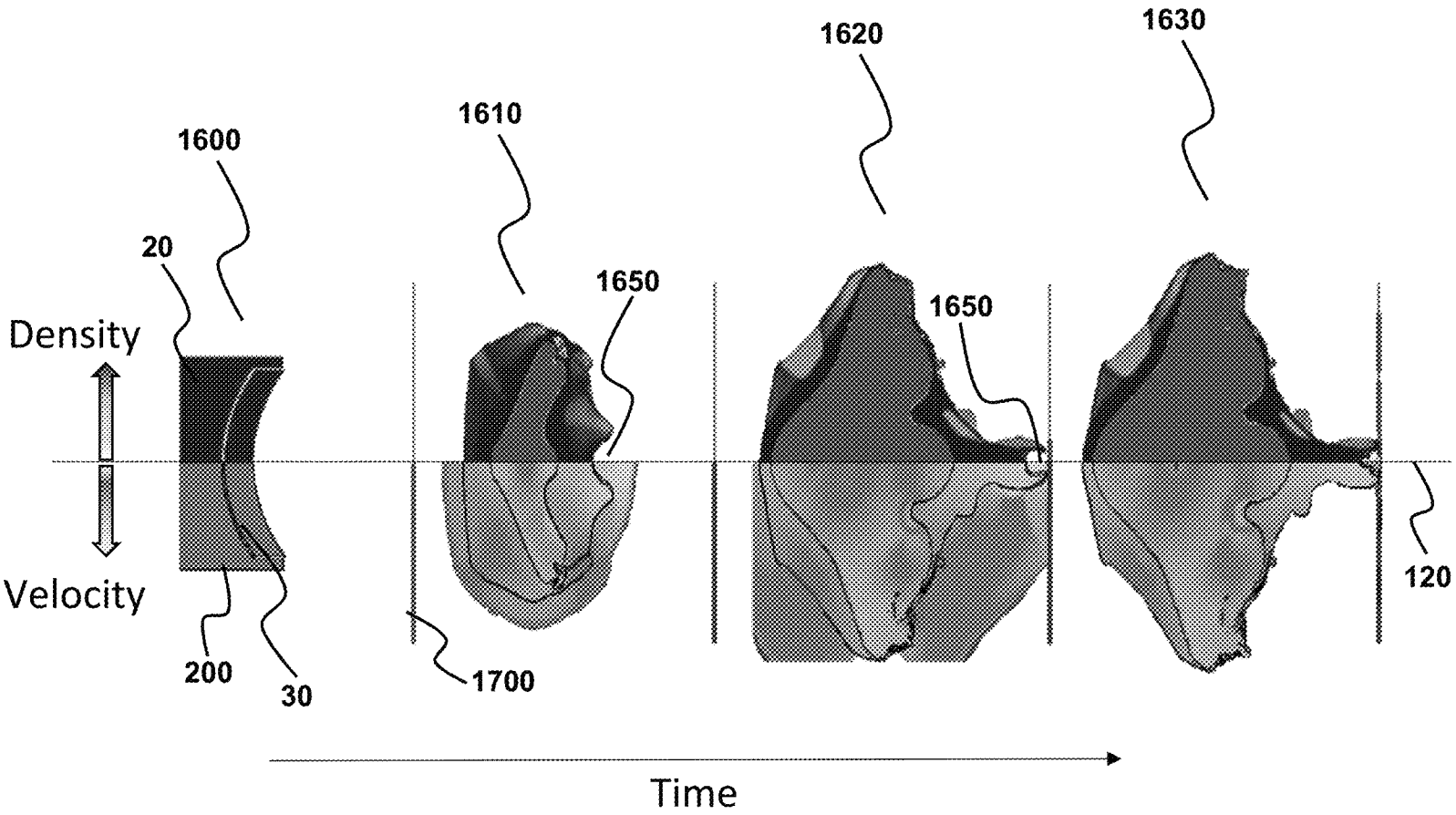
FIG. 16 provides in-silico results of the CAT in use. The upper and lower halves are contour plots of fluid density and velocity, respectively with four different time-points illustrated.

Resultant fluid jet profile over time upon detonation of shape-conforming explosives with the detonator are summarized in FIG. 16. Panel 1600, before detonation, the plastic shell 30 is immersed in fluid mass 20 constrained in the interior volume of the plastic body 200, with the shaped charge aligned to a target 1700. Panel 1610 illustrates fluid velocity and density immediately after detonation with initial fluid jet formation and beginning of fluid jet annulus 1650 formation. Panel 1620 illustrates fluid jet shape immediately prior to target contact, with the fluid-jet having a well-defined annular cross-section 1650. In this manner, a fluid "ring" impacts target as shown in panel 1630, with the various attendant functional benefits described herein with respect to reduced unwanted shock-initiation while preserving good penetration power with a well-defined path along the central longitudinal axis 120. FIG. 16, and additional in silico experiments, establishes from the velocity maps a reduced forward velocity gradient, thereby maintaining good fluid jet properties, in agreement with empirical observations.

Figure 17:
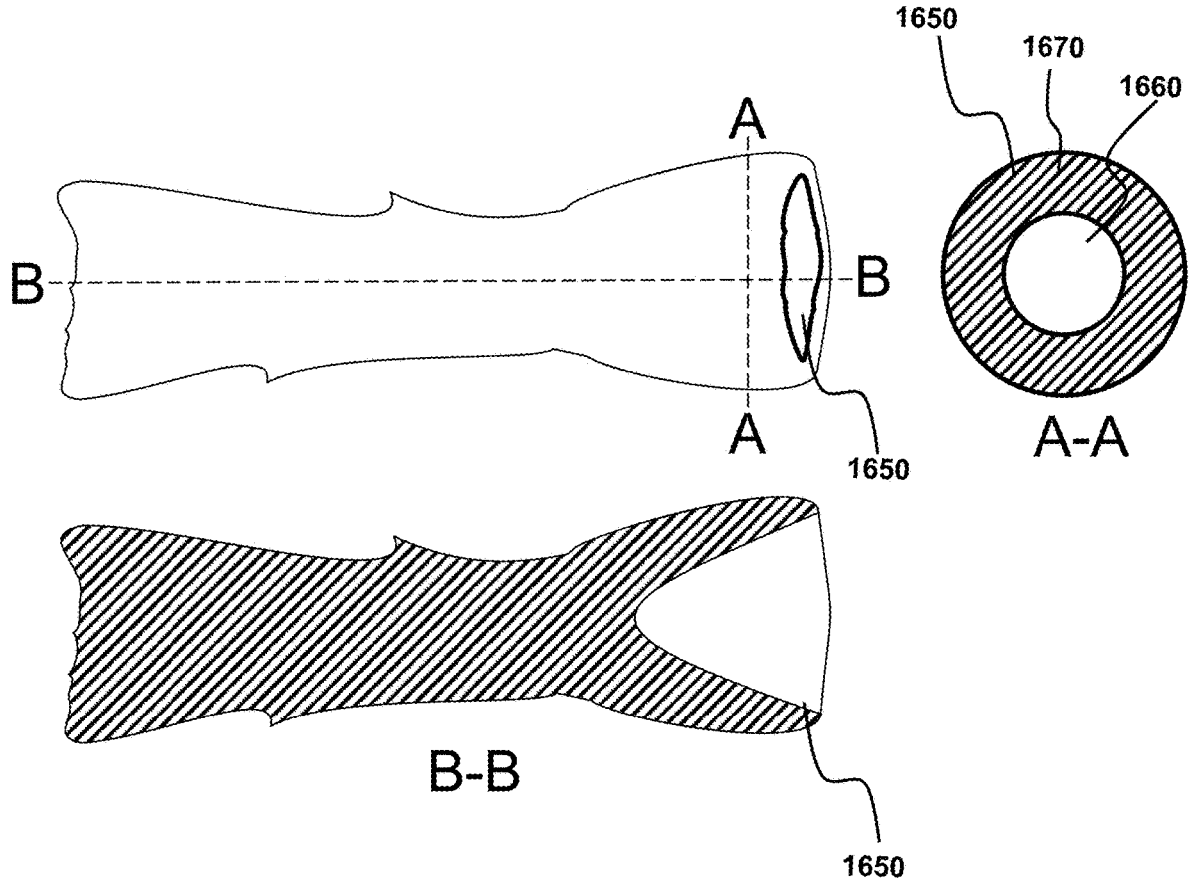
FIG. 17 is a graphic representation of a fluid jet generated by a shaped charge of the instant invention with cross-section A-A illustrating the fluid ring with annulus and cross-section B-B the fluid ring with annulus that develops toward the direction of a target (not shown).
Figure 18:
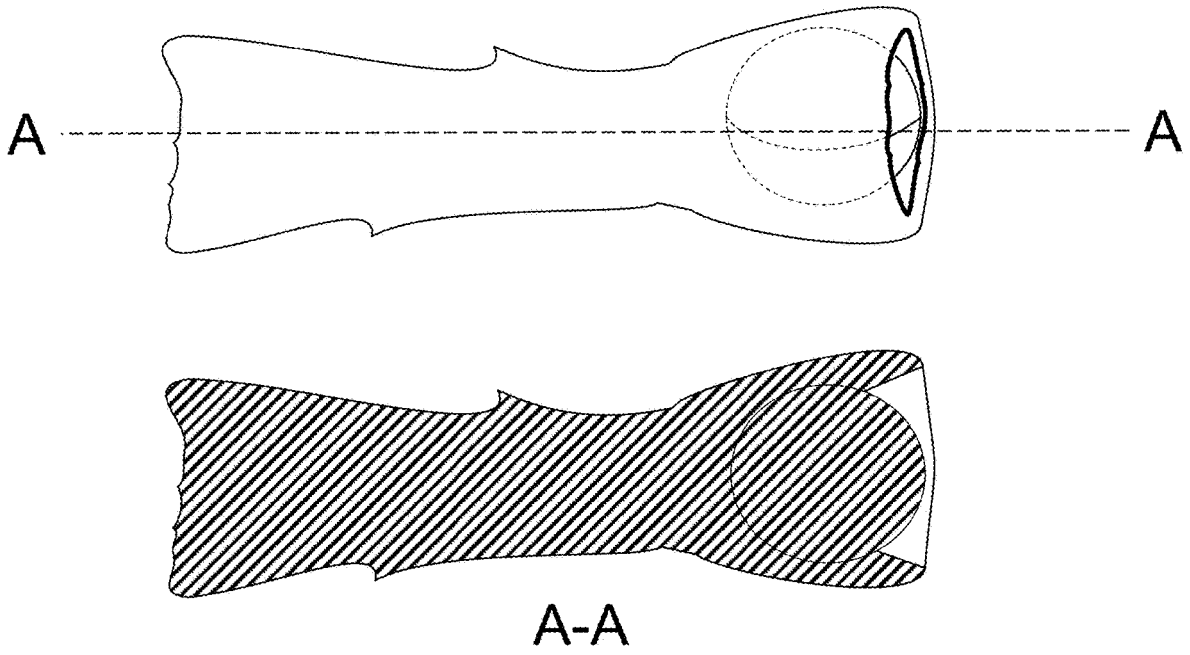
FIG. 18 graphic representation of a fluid jet generated by a shaped charge of the instant invention with a spherical projectile (top panel). The bottom panel is a cross-section view through the line A-A of the top panel.

FIGS. 17-18 illustrate fluid jet shape after use of shaped charge to explosively propel a fluid toward a target. FIG. 17 top left panel illustrates a side view of the fluid jet that is propelled from the left toward the right side of the page, with sectional lines A-A and B-B. A jet annulus 1650 develops at a distal end of the fluid jet toward a target (not shown). Section A-A illustrates a cross-section slice at the distal end of the fluid jet, with an annular region 1660 formed by a fluid ring 1670. Section B-B (bottom panel) is a cross-section along the Central longitudinal axis illustrating that jet annulus forms from the fluid jet in a distal direction toward a target, such that initial contact with target is by a fluid ring 1670.

Example 4: Metal Spheres

Any of the systems and methods described herein may be used with a rounded projectile that is formed of a metal or metal component in the form of a shell of diameter (D) with a wall thickness (W). Metal spheres (also referred herein as Metal Megaspheres (MM)) have same diameter range as previously specified. Metal Megaspheres have same mass weight range as previously specified, particularly as there is to be matching to fluid density.

Representative examples of shell materials include, but are not limited to, mild steel such as A36 alloy. Tool Steel is the strongest material, such as C300, S7, Chromium alloy. Titanium alloys are approximately half the density of steel. An example is Grade 5 titanium (6AL-4V alloy). Aluminum alloys are approximately one-third the density of steel. Aluminum shells can be aircraft aluminum, such as 6061, 7075. Brass and Copper Alloys are non-sparking. Examples are Brass 360, Beryllium brass, or Beryllium copper. As described, the wall thickness of any given material can be mathematically determined from Eq. (1), based on the projectile diameter, metal density, and liquid effective density.

The metal rounded projectile may have a hollow interior. The metal rounded projectile have a low density filler in an interior portion, including but not limited to: polyurethane; nylon; polycarbonate; synthetic rubber; natural rubber; high density foam; carbon fiber reinforced polymer, including to provide better effective density matching, thereby accommodating various metal shell wall thicknesses. Filler can contain microparticles or other additives, such as ceramic or glass microbubbles/microspheres. Again, this provides further adjustability to the density of plastics and synthetic rubbers.

Figure 20:
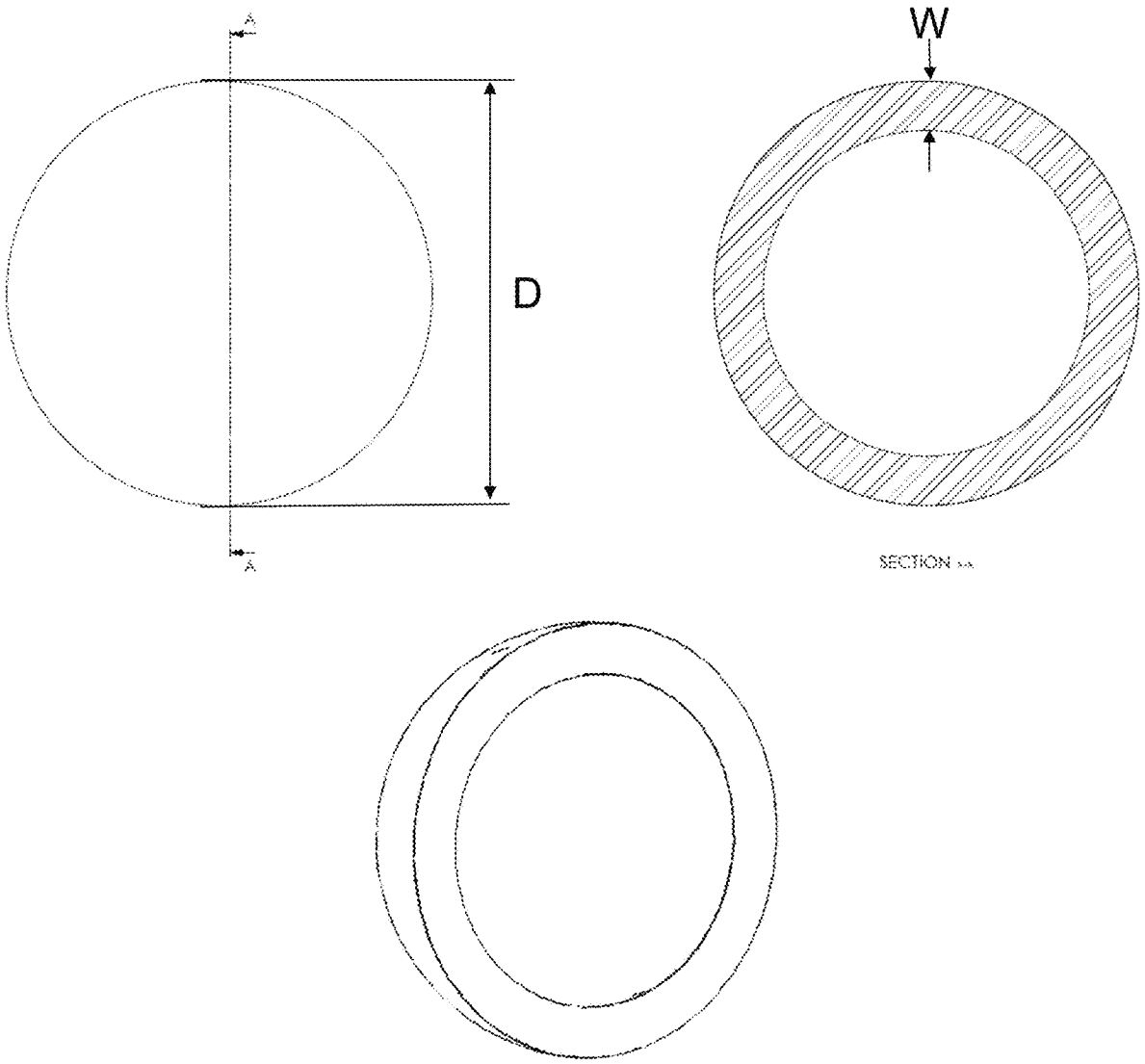
FIG. 20 illustrates a spherical projectile of diameter D formed of an outer layer of metal having a wall thickness W.
Figure 21A:
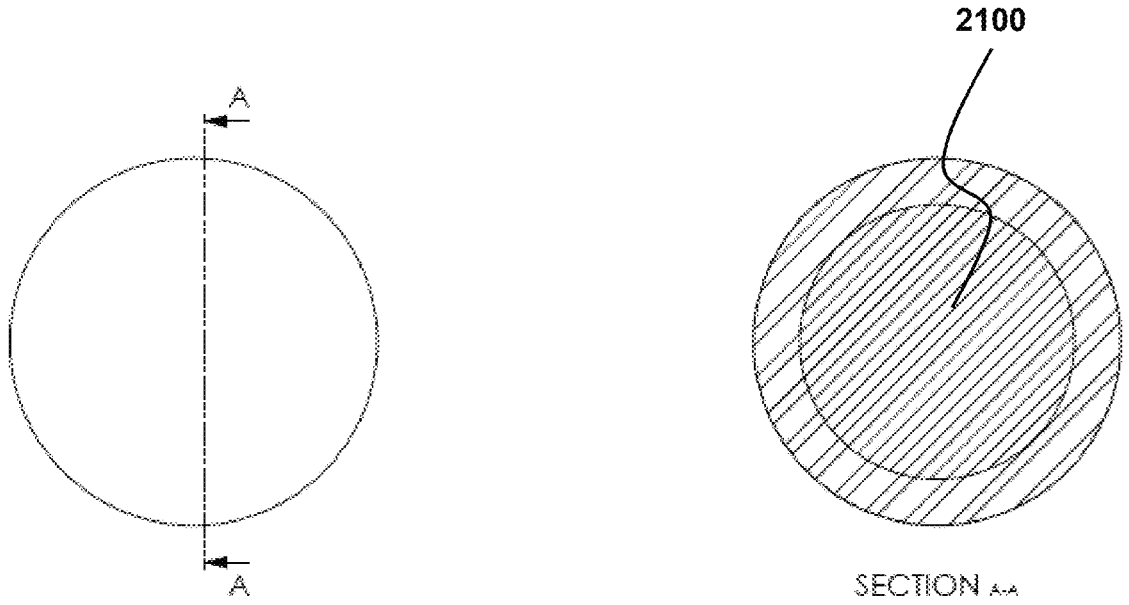
FIG. 21A illustrates metal projectile with a hollow core filled with a filler, including a low density filler having a density lower than the density of the metal, to better match the liquid density.
Figure 21B:
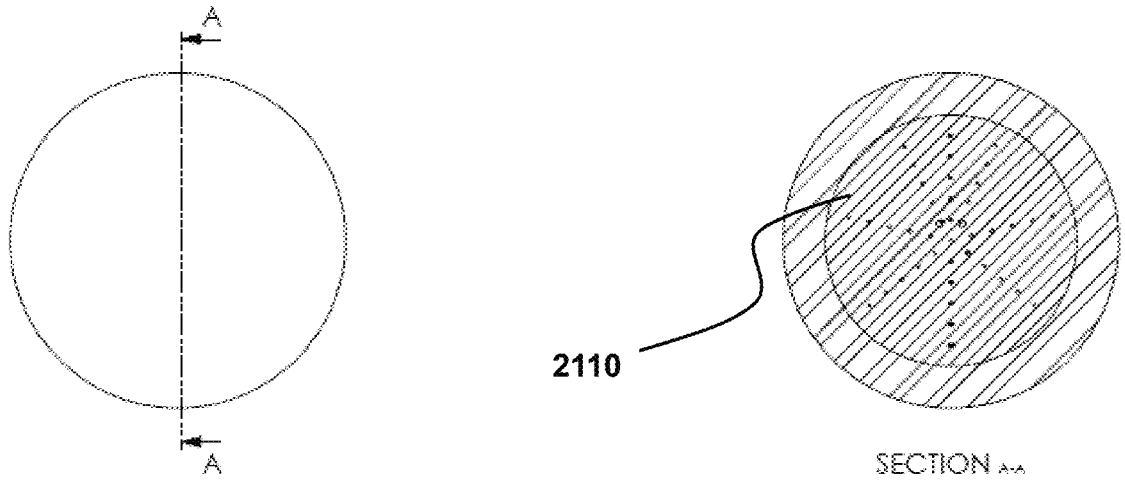
FIG. 21B illustrates the hollow core filled with a filler having microparticles, including ceramic microbubbles.

Examples of hollow rounded projectiles include FIG. 15 of 62/884,961, as well as FIG. 20, which illustrates the parameters W and D for Eq. (1). Filler 2100 is illustrated in FIG. 21A and filler containing microparticles, such as ceramic microbubbles is illustrated in FIG. 21B.

Figure 22:
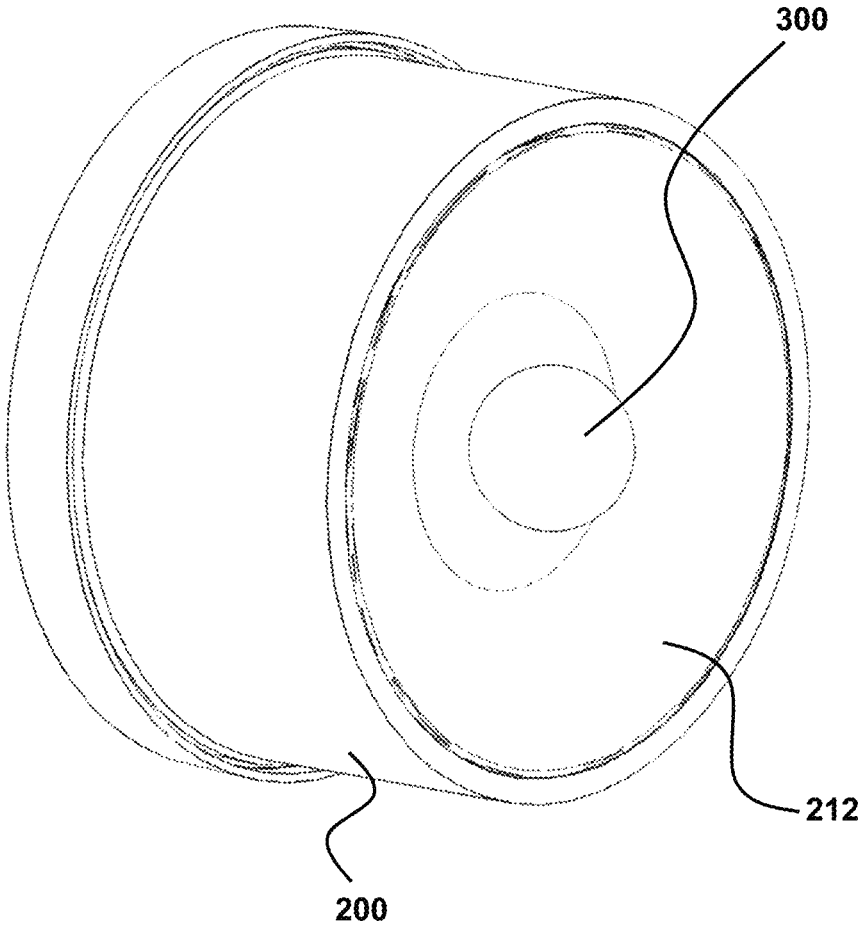
FIG. 22 illustrates a JSP, exemplified as spherical projectile, with the shaped charge. An adhesive or tape is required to position the JSP.
Figure 23:
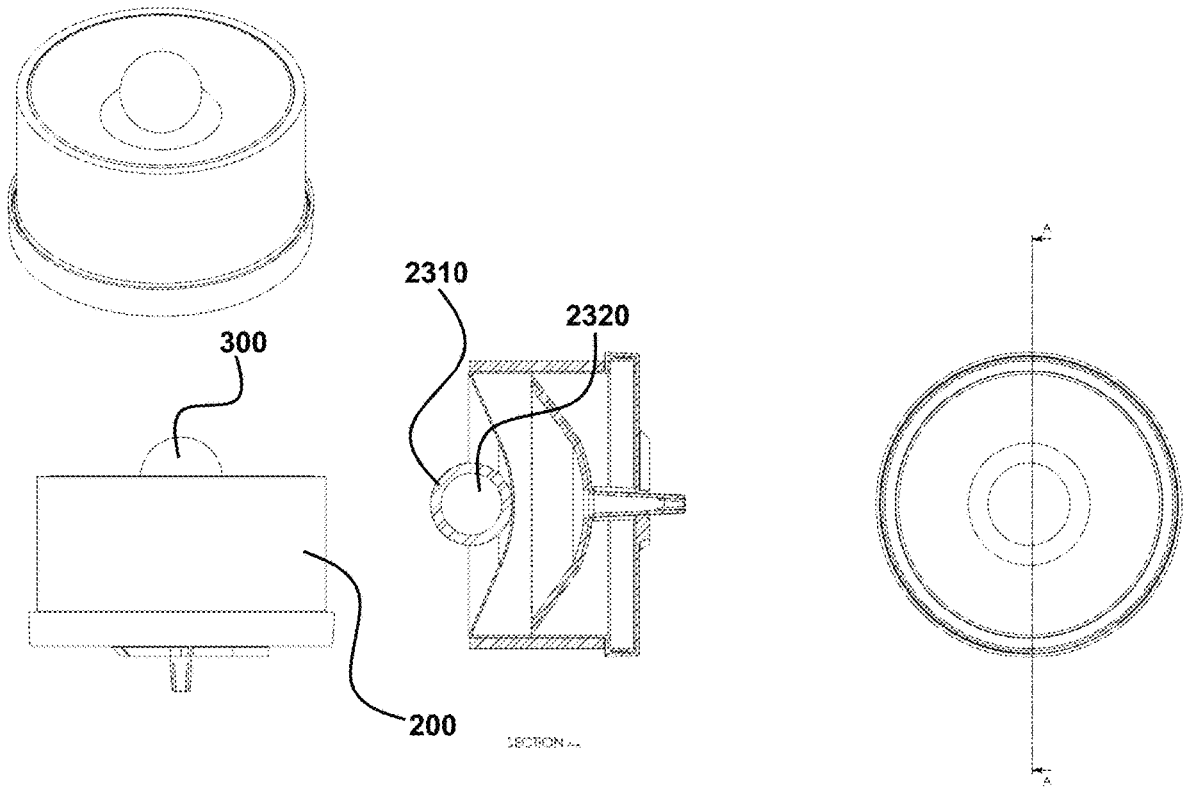
FIG. 23 illustrates other views of FIG. 22.

FIG. 22, similar to FIG. 2 illustrates that no holder is necessary to hold rounded projectile (e.g., hollow metal sphere) 300 to the cylindrical plastic body 200, including the exterior surface of the plastic body distal end. As needed, an adhesive may be positioned between the projectile and the face. The shape of the exterior-face 212 plastic body distal end can facilitate co-axial location with the central longitudinal axis. Other views of FIG. 22 are illustrated in FIG. 23, with the hollow metal 2300 configuration illustrated in the bottom middle panel cross-section showing an outer layer of metal 2310 and the hollow core 2320.

Figure 24:
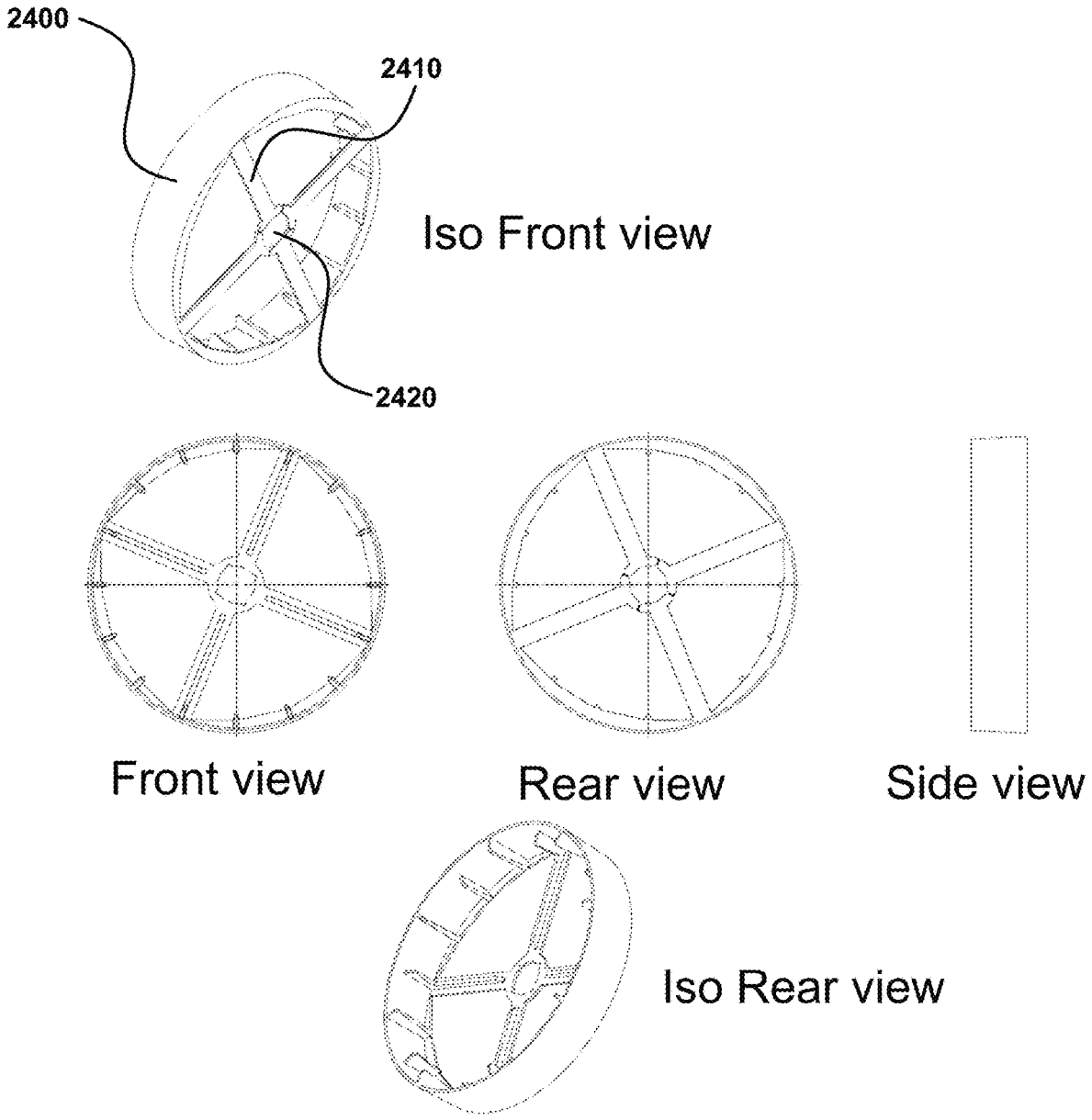
FIG. 24 illustrates an optional holder for holding a spherical projectile.
Figure 25:
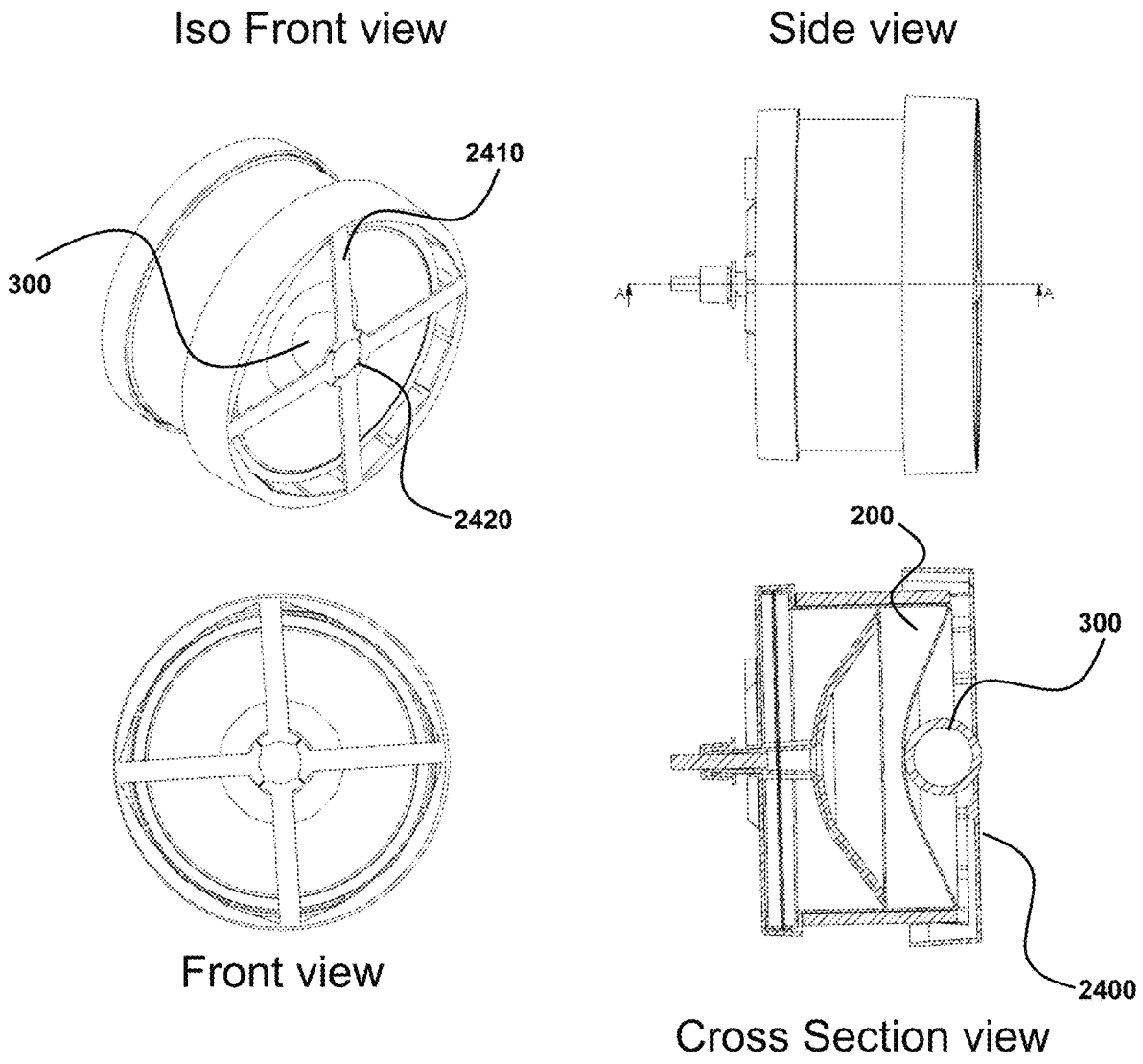
FIG. 25 illustrates use of an optional holder with the shaped charge.
Figure 26:
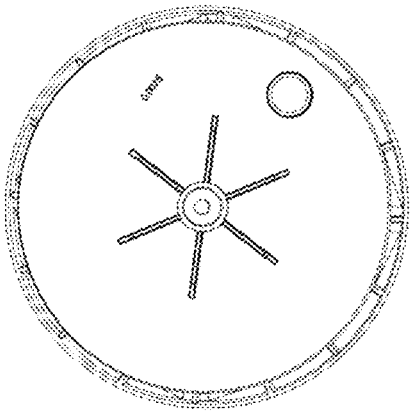
FIG. 26 is a rear view of FIG. 25.
Figure 26:
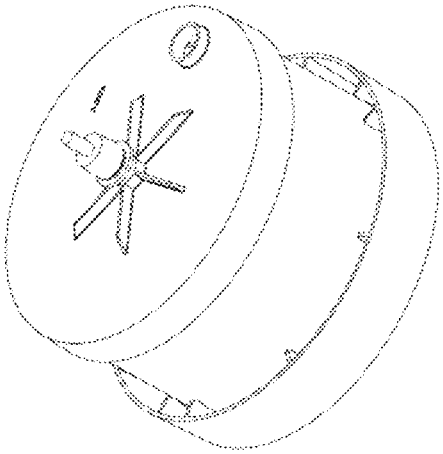

Optionally, the rounded projectile may be held in place with a holder 2400, including as illustrated in FIGS. 24-26. The holder is configured to trap and center the rounded projectile on the front face of the CAT. The holder may be formed of a thin material that fractures during use, such as a thin plastic. The holder may be configured to have specific stress lines in structure, including holder elements 2410, that in combination center the rounded projectile 300 between projectile platform 2420 and the plastic body 200 distal end. Alternatively, the holder may correspond to an adhesive, such as glue or epoxy, that holds the projectile to the surface.

STATEMENTS REGARDING INCORPORATION BY REFERENCE AND VARIATIONS

All references throughout this application, for example patent documents including issued or granted patents or equivalents; patent application publications; and non-patent literature documents or other source material; are hereby incorporated by reference herein in their entireties, as though individually incorporated by reference, to the extent each reference is at least partially not inconsistent with the disclosure in this application (for example, a reference that is partially inconsistent is incorporated by reference except for the partially inconsistent portion of the reference).

The terms and expressions which have been employed herein are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments, exemplary embodiments and optional features, modification and variation of the concepts herein disclosed may be resorted to by those skilled in the art, and that such modifications and variations are considered to be within the scope of this invention as defined by the appended claims. The specific embodiments provided herein are examples of useful embodiments of the present invention and it will be apparent to one skilled in the art that the present invention may be carried out using a large number of variations of the devices, device components, methods steps set forth in the present description. As will be obvious to one of skill in the art, methods and devices useful for the present methods can include a large number of optional composition and processing elements and steps.

As used herein and in the appended claims, the singular forms "a", "an", and "the" include plural reference unless the context clearly dictates otherwise. Thus, for example, reference to "a cell" includes a plurality of such cells and equivalents thereof known to those skilled in the art. As well, the terms "a" (or "an"), "one or more" and "at least one" can be used interchangeably herein. It is also to be noted that the terms "comprising", "including", and "having" can be used interchangeably. The expression "of any of claims XX-YY" (wherein XX and YY refer to claim numbers) is intended to provide a multiple dependent claim in the alternative form, and in some embodiments is interchangeable with the expression "as in any one of claims XX-YY."

When a group of substituents is disclosed herein, it is understood that all individual members of that group and all subgroups, are disclosed separately. When a Markush group or other grouping is used herein, all individual members of the group and all combinations and subcombinations possible of the group are intended to be individually included in the disclosure.

Every device, system, formulation, combination of components, or method described or exemplified herein can be used to practice the invention, unless otherwise stated.

Whenever a range is given in the specification, for example, a temperature range, a time range, or a composition or concentration range, all intermediate ranges and subranges, as well as all individual values included in the ranges given are intended to be included in the disclosure. It will be understood that any subranges or individual values in a range or subrange that are included in the description herein can be excluded from the claims herein.

All patents and publications mentioned in the specification are indicative of the levels of skill of those skilled in the art to which the invention pertains. References cited herein are incorporated by reference herein in their entirety to indicate the state of the art as of their publication or filing date and it is intended that this information can be employed herein, if needed, to exclude specific embodiments that are in the prior art. For example, when composition of matter are claimed, it should be understood that compounds known and available in the art prior to Applicant's invention, including compounds for which an enabling disclosure is provided in the references cited herein, are not intended to be included in the composition of matter claims herein.

As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. In each instance herein any of the terms "comprising", "consisting essentially of" and "consisting of" may be replaced with either of the other two terms. The invention illustratively described herein suitably may be practiced in the absence of any element or elements, limitation or limitations which is not specifically disclosed herein.

One of ordinary skill in the art will appreciate that starting materials, biological materials, reagents, synthetic methods, purification methods, analytical methods, assay methods, and biological methods other than those specifically exemplified can be employed in the practice of the invention without resort to undue experimentation. All art-known functional equivalents, of any such materials and methods are intended to be included in this invention. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

We claim:

1. A shaped charge for focusing a fluid mass comprising:
a plastic shell having a surface with a geometric shape configured to support a shape-conforming explosive, wherein the geometric shape comprises:
a truncated cone having an open distal end and a closed proximal end, the closed proximal end having a smoothly-curved concave shape;
an outer circumference with a plurality of cut-outs radially spaced around the outer circumference;
wherein the geometric shape is axially-symmetric about a central longitudinal axis;
a cylindrical plastic body having an interior volume for containing a liquid and the plastic shell, the cylindrical plastic body having:
a plastic body closed distal end having a geometric shape that is substantially matched to the concave shape of the plastic shell closed proximal end;
a plastic body proximal end that faces the plastic body distal end;
wherein the plastic shell is concentrically positioned to the cylindrical plastic body with respect to the central longitudinal axis;
a channel extending through the cylindrical plastic body proximal end and terminating at the plastic shell surface at a contact position coincident with the central longitudinal axis, wherein the channel is configured to accommodate a detonator; and
a spherical projectile positioned adjacent to an exterior surface of the plastic body distal end and co-axially located with the central longitudinal axis, wherein the spherical projectile has an effective density matched to an effective density of the liquid positioned in the cylindrical plastic body interior volume.

2. The shaped charge of claim 1, further comprising the shape-conforming explosive mated to at least a portion of the plastic shell surface.

3. The shaped charge of claim 1, wherein the plastic body proximal end comprises an end cap that fluidically seals the liquid and plastic shell in the cylindrical plastic body interior volume.

4. The shaped charge of claim 3, further comprising a detonator in a press-fit configuration in the channel to fluidically seal the liquid in the interior volume.

5. The shaped charge of claim 1, further comprising a fluid positioned in the interior volume.

6. The shaped charge of claim 1, wherein the effective density of the spherical projectile is within 20% of an effective density of the liquid.

7. The shaped charge of claim 1, wherein the plastic body has a sidewall thickness and a front face thickness, wherein the sidewall thickness is between 2 and 4 times thicker than the front face thickness.

8. The shaped charge of claim 1, wherein the plastic body has a sidewall and a front face, and the sidewall is formed of a plastic material having a higher density than a plastic material of the front face.

9. The shaped charge of claim 1, wherein an outer surface of the plastic body distal end comprises a plurality of scores to generate petal formation, prevent cylindrical plastic body impact on the target during use and minimize risk of unwanted shock initiation.

10. The shaped charge of claim 1, wherein the spherical projectile is formed of a metal.

11. The shaped charge of claim of claim 1, wherein the spherical projectile comprises an outer layer of metal or a metal having a hollow core.

12. The shaped charge of claim 11, wherein the metal is selected from the group consisting of: mild steel; tool steel; chromium alloy; titanium alloy; aluminum alloy; brass alloy; and copper alloy.

13. The shaped charge of claim 11, wherein the hollow core holds a filler selected from the group consisting of: polyurethane; nylon; polycarbonate; synthetic rubber; natural rubber; high density foam; carbon fiber reinforced polymer, ceramic microspheres; glass microspheres; and any combinations thereof.

14. The shaped charge of claim 1, wherein the spherical projectile shape and effective density is selected such that during use the liquid and spherical projectile explosively ejected from a disrupter form a liquid jet that encapsulates 10% to 75% of an outer surface of the spherical projectile.

15. The shaped charge of claim 1, wherein the spherical projectile is a hollow metal with a spherical projectile specific gravity of between 0.8 and 1.5.

16. The shaped charge of claim 1, further comprising a holder that holds the spherical projectile against the exterior surface of the plastic body distal end.

17. A method of disrupting an explosive target, the method comprising the steps of:
providing the shaped charge of claim 1 with a liquid positioned in the interior volume, wherein the plastic shell is immersed in the liquid;
aligning the mass focusing shaped charge with an explosive target;
initiating a detonation wave in the shape-conforming explosive that travels substantially parallel to the longitudinal axis, wherein the geometric shape and position of the plastic shell and the plastic body distal end are configured to generate a tamp and timing of rarefaction waves to increase a pressure duration and amplitude to drive the liquid toward the explosive target;
generating a liquid jet;
stabilizing the liquid jet with the spherical projectile, wherein the liquid jet flows forward around a rear surface of the spherical projectile to hydraulically stabilize the spherical projectile;
thereby disrupting the explosive target.

18. The method of claim 17, wherein the spherical projectile is formed of a metal.

19. The method of claim 17, wherein the metal is an outer layer of metal or a metal having a hollow interior.

20. The method of claim 17, wherein the liquid is water, a highly efficient energy transfer fluid, corn syrup or molasses.

* * * * *